US011480188B2

(12) United States Patent
Van-De-Velde et al.

(10) Patent No.: US 11,480,188 B2
(45) Date of Patent: Oct. 25, 2022

(54) INTEGRATED PRESSURIZED PUMP SHAFT SEAL ASSEMBLY AND METHOD OF USE THEREOF

(71) Applicant: Dajustco IP Holdings Inc., Coquitlam (CA)

(72) Inventors: Peter Francis Van-De-Velde, Coquitlam (CA); Nicholas James Guenther, Coquitlam (CA)

(73) Assignee: Dajustco IP Holdings Inc., Coquitlam (CA)

( * ) Notice: Subject to any disclaimer, the term of this patent is extended or adjusted under 35 U.S.C. 154(b) by 79 days.

(21) Appl. No.: 17/169,196

(22) Filed: Feb. 5, 2021

(65) Prior Publication Data

US 2021/0156392 A1 May 27, 2021

Related U.S. Application Data

(63) Continuation-in-part of application No. 15/108,755, filed as application No. PCT/CA2015/000022 on Jan. 5, 2015, now abandoned.

(Continued)

(51) Int. Cl.
*F04D 29/10* (2006.01)
*F04D 13/08* (2006.01)

(Continued)

(52) U.S. Cl.
CPC ..... *F04D 29/106* (2013.01); *F04D 13/08* (2013.01); *F04D 29/046* (2013.01);

(Continued)

(58) Field of Classification Search
CPC .... F04D 29/106; F04D 29/5806; F04D 29/06; F04D 29/108; F04D 29/063;

(Continued)

(56) References Cited

U.S. PATENT DOCUMENTS 2,506,827 A * 5/1950 Goodner ..... F04D 13/083 310/87
6,379,127 B1 * 4/2002 Andrews ..... F04D 13/083 277/408

(Continued)

OTHER PUBLICATIONS

European Patent Office, European Search Report dated Oct. 25, 2021, issued in relation to the corresponding European patent application No. EP 21275064.0.

*Primary Examiner* — Essama Omgba
*Assistant Examiner* — Christopher J Brunjes
(74) *Attorney, Agent, or Firm* — Antony C. Edwards

(57) ABSTRACT

An integrated pressurized pump shaft seal assembly for a submersible rotary fluid pump comprises an oil reservoir having a pressure equal or less than the ambient pressure external fluids surrounding the casing, the oil reservoir feeding an oil pump impeller that is mountable onto, so as to be rotated by, the rotary fluid pump shaft. The impeller is a radial hole impeller in fluid communication with an adjacent diffusion element comprising an internal diffusion bore in fluid communication with an axially vertical spiral volute diffusion chamber located between inner and outer walls of a mechanical seal housing. The centrifugal oil pump impeller pumps oil from the oil reservoir to the seal chamber through the diffusion element and the internal volute diffusion element so as to increase a pressure within the seal chamber to a positive pressure above the ambient pressure of the external fluids surrounding the pump housing.

18 Claims, 16 Drawing Sheets

Related U.S. Application Data

(60) Provisional application No. 61/923,675, filed on Jan. 5, 2014.

(51) Int. Cl.
*F04D 29/58* (2006.01)
*F04D 29/06* (2006.01)
*F04D 29/046* (2006.01)

(52) U.S. Cl.
CPC ..... *F04D 29/061* (2013.01); *F04D 29/586* (2013.01); *F04D 29/5806* (2013.01)

(58) Field of Classification Search
CPC ..... F04D 29/047; F04D 29/445; F04D 13/08; F04D 1/00; F16N 7/40; F16N 7/366; F01M 2001/0207; F05B 2210/11; F05B 2240/30; F05B 2240/57; F05B 2260/205; F16J 15/34; F16J 34/04
See application file for complete search history.

(56) References Cited

U.S. PATENT DOCUMENTS

| | | | | |
|---|---|---|---|---|
| 6,422,822 | B1 * | 7/2002 | Holmes | F04D 29/128 417/423.3 |
| 2011/0123337 | A1 * | 5/2011 | Tarui | F04D 7/04 416/144 |
| 2013/0183178 | A1 * | 7/2013 | Bottan | F04D 25/0686 417/423.3 |
| 2013/0285330 | A1 | 10/2013 | Kawabata et al. | |

* cited by examiner

INTEGRATED PRESSURIZED PUMP SHAFT SEAL ASSEMBLY AND METHOD OF USE THEREOF

RELATED APPLICATIONS

The present application is a continuation-in-part of U.S. patent application Ser. No. 15/108,755 that was entered into the United States on Jun. 28, 2016, which is the national phase entry application of Patent Cooperation Treaty ("PCT") patent application no. PCT/CA2015/000022 filed on Jan. 5, 2015, which PCT application claims priority to U.S. patent application No. 61/923,675 filed on Jan. 5, 2014, all of which are incorporated herein by reference.

TECHNICAL FIELD

The present disclosure relates generally to pump shaft seals and methods of use thereof. More specifically, the present disclosure relates to pump shaft seal assemblies, such as for submersible or semi-submersible pumps, which are adapted to be pressurized by an integrated seal pressure pump, and methods of use thereof.

BACKGROUND

Rotary fluid pumps are typically prone to malfunction and/or failure due to seal failure, such as failure of seals around the pump shaft that typically seal against ingress of pumped fluid into pump shaft bearings and/or a pump motor such as a typical electrical pump motor. Particularly in rotary pumps that pump abrasive fluids and slurries, wear and eventual failure of the pump shaft seals may be accelerated or worsened, leading to premature or undesirably frequent repair, servicing and/or replacement of pumps. Such undesirable pump malfunction and/or failure may result in expensive downtime and maintenance, leading to lost time and expense.

In some submerged pumps known in the art for operation at significant depths, pressure compensated seals may be used typically requiring external sources of compressed gases, air or other fluid pressure to balance pressures on both sides of pump seals. Prior art submerged pumps may include, for example, external pressurized oil sources which supply pressurized oil to the seal chamber; examples of such existing systems are described, for example, in U.S. Pat. No. 6,379,127 to Andrews (disclosing a pre-pressurized buffer fluid reservoir external to the submersible pump), and in U.S. Pat. No. 2,506,827 to Goodner (disclosing an oil reservoir disposed remote from the pump). Such typical external pressure sources known in pressure compensated submerged pumps may undesirably add complexity and expense and require reliance on pressure compensation equipment external to the pump system, which may be undesirable in many applications where lower cost, reliability and simplicity are desirable.

Accordingly, there exists a need for improved pressurized rotary pump seals and methods for their application that address some of the limitations of the pump seals known in the art.

SUMMARY

In the present disclosure, the applicant discloses improvements to the overall integrated pressurized pump shaft seal assembly, which incorporate elements of an integrated pressurized pump shaft seal assembly disclosed in the applicant's U.S. patent application Ser. No. 15/180,755 (the "755 application"), the entirety of which is incorporated herein by reference.

The applicant's 755 application discloses the concept of integrating a pressurization system within the pump housing, which pressurizes the oil contained within a seal chamber surrounding the mechanical seals of the pump, utilizing an integrated oil pump impeller that is mounted to, and rotated by, the shaft of the submersible pump. For pumps having no limitation on the size of the motor or the size of the pump casing, the integrated pump shaft seal assembly may be accomplished in the various embodiments described therein. However, the applicant has encountered various challenges with integrating the oil pump onto the pump shaft on existing submersible pump designs in order to generate a sufficient amount of pressure to counteract the external ambient pressure of the surrounding fluid, while at the same time limiting the amount of power drawn from the pump's motor by the oil pump impeller so as to avoid increasing the power rating of the motor of the existing pump designs. In particular, the applicant discovered that merely adding an oil pump impeller to the pump shaft was not sufficient to sufficiently pressurize the seal chamber, without increasing the power of the motor and/or increasing the diameter of the oil pump impeller, which also requires increasing the size of the pump casing.

To accomplish a sufficient amount of pressure without having to increase the horsepower of the pump's motor or increase the diameter of the oil pump impeller, the applicant developed an integrated pressurized pump shaft seal assembly which includes an internal volute diffusion chamber incorporated into existing internal pump components, including the existing mechanical seal housing, for converting the velocity of the pumped oil to a static pressure within the seal chamber. The overall assembly also includes improvements to the design of the oil pump impeller which maximized the efficiency of the pressurization assembly.

In some aspects of the present disclosure, an integrated pressurized pump shaft seal assembly for a submersible rotary fluid pump, the rotary fluid pump including a rotary fluid pump shaft, a rotary fluid pump motor and a pump casing is provided. The integrated pressurized pump shaft seal assembly comprises an oil reservoir having a pressure equal to or less than an ambient pressure of ambient pressure external fluids surrounding the pump casing, the oil reservoir disposed within the pump casing, the oil reservoir having a reservoir outlet flowing into an inlet of a centrifugal oil pump impeller, and the oil pump impeller is mountable onto, so as to be rotated by, the rotary fluid pump shaft. The inlet of the centrifugal oil pump impeller comprises a ridge defining an annular void in fluid communication with a plurality of bores extending radially outwardly to a plurality of impeller outlets located at a circumferential edge of the centrifugal oil pump impeller. The plurality of impeller outlets are in fluid communication with a diffusion element adjacent the centrifugal oil pump impeller, the diffusion element comprising an internal diffusion bore in fluid communication with an internal volute diffusion element, wherein the internal diffusion bore and internal volute diffusion element converts the velocity of oil pumped from the reservoir by the centrifugal oil pump impeller into static pressure. The internal volute diffusion element comprises an axially vertical spiral volute diffusion chamber located between an inner wall and an outer wall of a mechanical seal housing, and an outlet of the internal volute diffusion element flows into a seal chamber defined by the mechanical seal housing. The seal chamber encloses a mechanical shaft seal mountable onto said pump shaft, wherein the mechanical shaft seal prevents ingress of ambient pressure external fluids into the seal chamber. The centrifugal oil pump impeller pumps said oil received from said oil reservoir to said seal chamber through the diffusion element and the internal volute diffusion element so as to increase a pressure within said seal chamber to a positive pressure above the ambient pressure of the external fluids surrounding the pump housing so as to assist sealing by the mechanical shaft seal of the seal chamber.

In some embodiments, the integrated pressurized pump shaft seal assembly may have a mechanical seal housing that comprises one or more of: cooling fins adapted to cool the oil in the said seal chamber; and baffles adapted to reduce at least one of swirl and cavitation in said oil in the vicinity of the said mechanical shaft seal. The mechanical shaft seal may include first and second mechanical shaft seals. The axially vertical spiral volute diffusion chamber of the internal volute diffusion element, in some embodiments, has a wrap angle that is at least 90°. The axially vertical spiral volute diffusion chamber, in some embodiments, may have a downward angle selected in the range of 8° to 20°.

In some embodiments, the inlet angle of the plurality of bores is equal to zero and the outlet angle of the plurality of bores is equal to zero such that a central axis passing through each bore of the plurality of bores is perpendicular to the rotary fluid pump shaft. In some embodiments, the diffusion element further comprises a spiral passageway disposed on an upper surface of a bearing housing leading to an inlet of the internal diffusion bore, the internal diffusion bore passing axially and radially through a body of the bearing housing and having an outlet in fluid communication with an inlet of the spiral volute diffusion chamber. In some embodiments, the internal diffusion bore is linear. In some embodiments, the centrifugal oil pump impeller is positioned above a bearing assembly of the rotary fluid pump, while in other embodiments, the centrifugal oil pump impeller is positioned below a bearing assembly of the rotary fluid pump. In some embodiments, the oil pump impeller is sandwiched between the oil reservoir and the diffusion element. In some embodiments, the diffusion element comprises a spiral passageway disposed on a recessed portion of an upper surface of a diffuser leading to an inlet of the internal diffusion bore, the internal diffusion bore passing axially and radially through a body of the diffuser and having an outlet in fluid communication with an inlet of the spiral volute diffusion chamber.

In other aspects of the present disclosure, a rotary fluid pump comprises a rotary fluid pump motor, a rotary fluid pump shaft connected to said pump motor, a pump impeller mounted to said pump shaft and an integrated pressurized pump shaft seal assembly mounted to said pump shaft. The integrated pressurized pump shaft seal assembly comprises an oil reservoir having a pressure equal to or less than an ambient pressure of ambient pressure external fluids surrounding the pump casing, the oil reservoir disposed within the pump casing, the oil reservoir having a reservoir outlet flowing into an inlet of a centrifugal oil pump impeller, the oil pump impeller mountable onto, so as to be rotated by, the said rotary fluid pump shaft. The inlet of the centrifugal oil pump impeller comprises a ridge defining an annular void in fluid communication with a plurality of bores extending radially outwardly to a plurality of impeller outlets located at a circumferential edge of the centrifugal oil pump impeller. The plurality of impeller outlets are in fluid communication with an internal volute diffusion element adjacent the centrifugal oil pump impeller, wherein the internal volute diffusion element converts the velocity of oil pumped from the reservoir by the centrifugal oil pump impeller into static pressure. The internal volute diffusion element comprises an axially vertical spiral volute diffusion chamber located between an inner wall and an outer wall of a mechanical seal housing, and an outlet of the internal volute diffusion element flows into a seal chamber defined by the mechanical seal housing. The seal chamber encloses a mechanical shaft seal mountable onto said pump shaft, wherein the mechanical shaft seal prevents ingress of ambient pressure external fluids into the seal chamber, and the said centrifugal oil pump impeller pumps said oil received from said oil reservoir to said seal chamber through the internal volute diffusion element so as to increase a pressure within said seal chamber to a positive pressure above the ambient pressure of the external fluids surrounding the pump housing so as to assist sealing by the mechanical shaft seal of the seal chamber.

In some embodiments, the diffusion element has an internal diffusion bore, the internal diffusion bore in fluid communication with the outlet of the centrifugal oil pump impeller and an inlet of the volute diffusion chamber, wherein the pumped oil is transported from the outlet of the centrifugal oil pump impeller to the inlet of the volute diffusion chamber. In some embodiments, a check valve is located between the integrated centrifugal oil pump impeller and the seal chamber. In some embodiments, the wet end of the rotary fluid pump has an open stool, the open stool comprising the wet end vent so as to reduce the pressure of the external fluids acting on the mechanical seal generated by a pump impeller of the said wet end. In some embodiments, the rotary fluid pump additionally comprises a cooling jacket adapted for cooling said pump motor, wherein said cooling jacket is fluidly connected to said seal chamber by a pressure reducing valve and adapted to receive pressurized oil from said seal chamber while maintaining the positive pressure in the seal chamber and to return warmed oil from said cooling jacket to said oil reservoir.

In other embodiments, an integrated pressurized pump shaft seal assembly for a rotary fluid pump is provided, wherein the rotary fluid pump includes a rotary fluid pump shaft and a rotary fluid pump motor. The integrated pressurized pump shaft seal assembly comprises a non-pressurized oil reservoir, an integrated centrifugal oil pump directly attachable to so as to be rotated by said pump shaft, wherein said integrated centrifugal oil pump is directly fluidly connected to and abuts the oil reservoir to receive oil from said oil reservoir. A seal chamber directly fluidly connected to said integrated centrifugal oil pump sandwiches the integrated centrifugal oil pump between the oil reservoir and the seal chamber. A pump shaft bearing is mountable on said pump shaft and within said seal chamber so as to be lubricated by said oil, and a mechanical shaft seal is mountable on said pump shaft within the seal chamber to prevent ingress of ambient pressure external fluids into the seal chamber. The integrated centrifugal oil pump is configured to pump said oil received from said oil reservoir to said seal chamber to increase a pressure within said seal chamber to a positive pressure above the ambient pressure of the external fluids to assist sealing by said mechanical shaft seal of said seal chamber. The said positive pressure within the seal chamber is only achieved by the integrated centrifugal oil pump, and a fluid connection for the oil to flow between the oil reservoir and the seal chamber is only through the integrated centrifugal oil pump. The integrated pressurized pump shaft seal assembly may additionally include a check valve located between said integrated centrifugal oil pump and said seal chamber, and may additionally comprise a cooling jacket adapted for cooling said pump motor, wherein the cooling jacket is fluidly connected to said seal chamber by a pressure reducing valve and adapted to receive pressurized oil from said seal chamber while maintaining the positive pressure in said seal chamber and to return warmed oil from said cooling jacket to said oil reservoir. In some embodiments, at least one of a check valve located between said integrated centrifugal oil pump and said seal chamber, and a pressure reducing valve fluidly connected to said seal chamber, is closed when failure of said mechanical shaft seal is detected.

BRIEF DESCRIPTION OF THE FIGURES

The apparatus and methods of several embodiments of the present disclosure will now be described with reference to the accompanying drawing figures, in which:

FIG. 5A is a cross sectional perspective view of the integrated pressurized pump shaft seal assembly shown in FIG. 4C.

DETAILED DESCRIPTION

Figure 1:
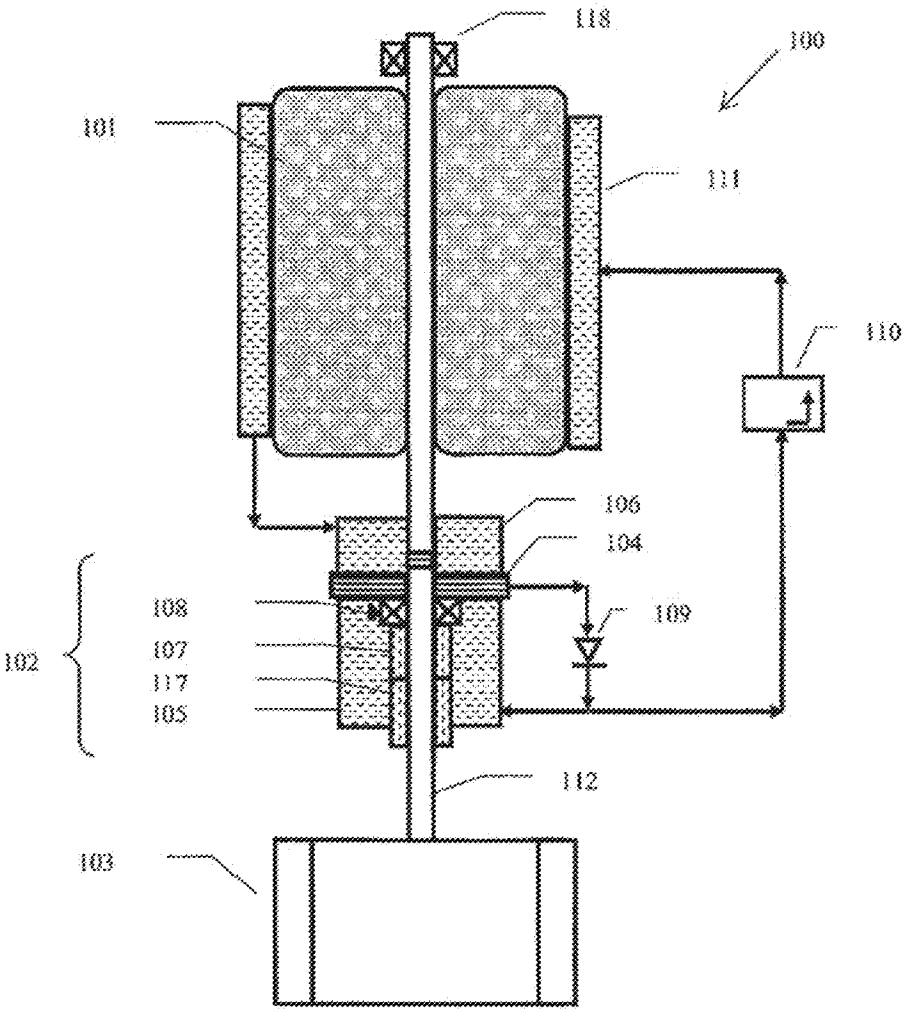
FIG. 1 is a schematic view of an integrated pressurized pump shaft seal according to an embodiment of the present disclosure, and a pump apparatus comprising the same, according to another embodiment of the present disclosure.

Referring to FIG. 1, a schematic view of an integrated pressurized pump shaft seal assembly 102 is shown, according to an embodiment of the present disclosure, and a pump apparatus 100 is also shown comprising the same, according to another embodiment of the present disclosure. In one embodiment, the pump 100 may comprise a rotary slurry or other fluid pump such as for pumping one or more of fluids, fluid/solid suspensions and slurries, for example. In a particular embodiment, the pump 100 may comprise a submersible and/or semi-submersible pump such as a semi-submersible slurry pump for example, and may comprise a pump motor such as an electric pump motor 101, an integrated pressurized pump shaft seal such as integrated pressurized pump shaft seal assembly 102, and a pump impeller/chamber assembly or "wet end" 103, for example. In one such embodiment, the electric pump motor 101 may drive the pump impeller assembly 103 through pump shaft 112, which may extend through the integrated pressurized pump shaft seal assembly 102, and may be supported by upper shaft bearings 118 and lower shaft bearings 108, for example.

In one embodiment, the integrated pressurized pump shaft seal assembly 102 may comprise at least one mechanical shaft seal, such as a mechanical shaft seal comprising upper seal face 107 and lower seal face 117 which are located within a seal chamber 105 that surrounds the upper seal face 107 and lower pump shaft bearings 108, and which is filled with oil or other suitable seal and/or bearing lubricating fluid. In a preferred embodiment, the integrated pressurized pump shaft seal assembly 102 comprises a dual mechanical seal arrangement comprising an upper mechanical seal 107, and a lower mechanical seal 117, which each comprise two mechanical seal faces engaged in rotational sealing contact with each other to provide a mechanical shaft seal on pump shaft 112. Mechanical seals 107, 117 may comprise any suitable mechanical seal design and/or materials, such as comprising silicon and/or tungsten carbide seal surfaces, for example, and in one embodiment of the present disclosure, upper and lower mechanical seals 107, 117 may each be provided as a cartridge mechanical seal, for example. Integrated pressurized pump shaft seal assembly 102 including mechanical seals 107 and 117 and further comprising a seal chamber 105 containing oil (or any other suitable seal and/or bearing lubricating fluid for example) may desirably be pressurized at a positive pressure above the ambient or sump pressure outside the seal chamber 105 and may therefore desirably prevent a pumped slurry, fluid or other contaminants from a submerged pump wet end 103 from entering seal chamber 105 containing and protecting the lower shaft bearings 108, and protecting the pump motor 101, for example. In one embodiment, the upper and lower mechanical seals 107 and 117 may also desirably protect pump motor 101, and any other pump components in the "dry end" of the pump from exposure to a pumped slurry, fluid or other contaminants from a submerged pump wet end 103, for example.

In one embodiment, the integrated pressurized pump shaft seal assembly 102 further comprises an oil pump 104 which may be desirably directly attached to and integrated with the pump shaft 112, such that the oil pump 104 is rotated and thereby powered directly by the pump shaft 112. In one embodiment, the oil pump 104 comprises a centrifugal impeller pump 104, such as a radial hole impeller pump, which is integrated with and rotated by the pump shaft 112 and is operable to provide a positive oil pressure within the seal chamber 105, to desirably pressurize seal chamber 105 to a desirably higher pressure than the surrounding sump or pumped fluid (such as a slurry) pressure inside the wet end 103 of the pump, or outside the seal chamber 105, for example, such as to desirably exclude a pumped fluid such as a slurry from entering the seal chamber 105, the upper and lower mechanical seals 107 and 117, and to desirably prevent contamination of and/or damage to bearings 108, or pump motor 101, for example. In one particular embodiment, pressurized seal chamber 105 may desirably be pressurized by oil pump 104 to a positive pressure of about 10 to 50 psi above the ambient pressure of a pumped fluid outside the seal chamber 105, such as the ambient pressure of pumped fluid or slurry in wet end 103, for example. In one embodiment, integrated pressurized pump shaft seal assembly 102 further comprises an oil reservoir 106, typically situated above seal chamber 105, and operable to contain and supply oil (or another suitable seal and/or bearing lubricating fluid) to oil pump 104, to be pressurized and supplied to seal chamber 105 at a positive pressure above the sump or external pressure of a pumped fluid or slurry outside of the seal chamber 105. In a particular embodiment, oil pump 104, such as a radial hole centrifugal impeller pump, may be attached to and integrated with pump shaft 112 such as by retaining oil pump 104 to shaft 112 by means of a retaining locknut. In a further such embodiment, integrated oil pump 104, bearings 108, and optionally a shaft sleeve (not shown) may be attached to pump shaft 112 by a common retaining locknut, for example, such that rotation of the pump shaft 112 by pump motor 101 is operable to rotate integrated oil pump 104. In a particular embodiment, bearings 108 may be open to seal chamber 105, such that oil or another suitable lubricating fluid pressurized in chamber 105 by oil pump 104 may provide lubrication to bearings 108. In a further such embodiment, bearings 108 may comprise a bearing housing (not shown) which may desirably comprise a bearing oil pool or reservoir which may retain residual oil to lubricate bearings 108 even if seal chamber 105 loses pressure and is at least partly drained of oil, such as in the event of failure of lower mechanical seal 117, for example. In a particular embodiment, upper and lower mechanical seals 107, 117, may desirably be configured to sealingly accommodate a desired pressure differential between pressurized seal chamber 105 and the lower ambient pressure of a pumped fluid outside the seal chamber 105.

In one embodiment, integrated pressurized seal assembly 102 further comprises a check valve 109, located between integrated oil pump 104 and pressurized seal housing 105. In a particular such embodiment, check valve 109 may desirably be operable to prevent backflow of oil from seal chamber 105 to oil reservoir 106, through integrated oil pump 104, such as may otherwise occur upon shutdown of the pump motor 101, and may undesirably lead to contamination of oil reservoir 106 following eventual failure of lower mechanical seal 117, for example. Since mechanical seals 107, 117 are subject to wear and eventual failure upon extended operation of pump 100, even with the assistance of pressurized seal chamber 105 which may desirably exclude pumped fluid (such as a pumped slurry) from entering mechanical seals 107, 117 during normal operation, check valve 109 may also be operable to close upon detection of failure of lower mechanical seal 117, such as to keep pumped fluid and/or moisture from entering oil reservoir 106, such as through the integrated oil pump 104. In one such embodiment, check valve 109 may comprise a pressure-actuated valve such that the check valve 109 closes if the pressure in the seal chamber 105 decreases below a desired minimum pressure and whereby such closing of valve 109 may desirably reduce or prevent admission of fluid to oil reservoir 106. In another such embodiment, a sensor (not shown) may be provided that is operable to detect failure of lower mechanical seal 117, and to trigger closure of check valve 109 upon such failure. In another embodiment, a sensor may also be provided that may trigger an alarm or other suitable indication (such as an indicator light or signal for example) to notify a user of the failure of the lower mechanical seal 117. In a further optional embodiment, one or more sensors may also be provided to detect one or more of: failure of lower or upper mechanical seals 107, 117; low oil level in oil reservoir 106; water and/or moisture ingress into seal chamber 105; and a drop in oil pressure in seal chamber 105 below a desired minimum level; faults, and such sensor(s) may further be operable to trigger an alarm or other suitable 10 indication to notify a user of one or more of such faults.

In another embodiment of the present disclosure, the pump apparatus 100 may additionally comprise a cooling jacket 111, such as for circulating oil (or other suitable lubricating fluid) from oil reservoir 106 under pressure from oil pump 104, to cool pump motor 101 (such as a typical electric pump motor 101). In one such embodiment, such as for use in a semi-submerged pump, oil from oil reservoir 106 may be pumped into seal chamber 105 by integrated oil pump 104 driven by rotation of pump shaft 112, to pressurize seal chamber 105 at a positive pressure above an outside ambient fluid pressure, and a portion of oil in seal chamber 105 may be admitted through a pressure reducing valve 110 (which may normally be open) to circulate cooling jacket 111 surrounding at least a portion of pump motor 101. Such circulation of oil from seal chamber 105 through pressure reducing valve 110 to cooling jacket 111 and back to oil reservoir 106 before returning to seal chamber 105 through oil pump 104, may desirably circulate heat from pump motor 111 to seal chamber 105, where the circulated oil may be cooled by typically cooler surrounding ambient pumped fluid located outside of the seal chamber 105. In one such embodiment, pressure reducing valve 110 may desirably be configured to maintain a desired minimum positive pressure in seal chamber 105 such as by limiting and/or controlling flow of oil through valve 110 and cooling jacket 111, for example, to maintain pressurization of seal chamber 105 at or above the desired minimum positive pressure. In a particular embodiment, seal chamber 105 and any optional surrounding housing around seal chamber 105 (not shown) may desirably be comprised of a suitably thermally conductive material, such as aluminum for example, so as to desirably allow dissipation of heat from oil in seal chamber 105 (and optionally also from oil reservoir 106) to typically cooler pumped fluid located outside of the chamber 105 and/or housing. In one such embodiment, walls of seal chamber 105 and/or a further optional seal chamber housing may additionally include cooling fins or other suitable structures such as to improve heat dissipation from the oil chamber 105 to an ambient fluid outside of the chamber.

Similar to the check valve 109 described above, pressure reducing valve 110 may also be operable to close upon detection of failure of lower mechanical seal 117, such as to keep pumped fluid and/or moisture from entering cooling jacket 111. In one such embodiment, a sensor (not shown) may be provided that is operable to detect failure of lower mechanical seal 117, and to trigger closure of pressure reducing valve 110 upon such failure. In another embodiment, a sensor may also be provided that may trigger an alarm or other suitable indication (such as an indicator light or signal for example) to notify a user of the failure of the lower mechanical seal 117. In a further embodiment, following failure of the lower mechanical seal 117, the upper mechanical seal 107 may desirably operate to prevent ingress of moisture, pumped fluid or other contaminants from entering the pump motor 101 and desirably also the seal chamber 105 and bearing 108 until the pump may be repaired and/or replaced. In another embodiment, an optional oil filter (not shown) may be provided such as between the seal chamber 105 and the check valve 109, or between the oil reservoir 106 and the oil pump 104, for example, to desirably provide additional protection against contamination of the oil in seal chamber 105 and provide increased bearing life of bearings 108. In yet another embodiment, in a case following failure of both upper and lower mechanical seals 107, 117, the oil pump 104 may desirably act as a dynamic seal such as by pumping any fluid (such as including contaminating pumped fluid or other contaminants) entering the oil reservoir 106 back down to seal chamber 105, and away from pump motor 101, thereby desirably preventing any such fluid from entering and potentially damaging pump motor 101 and desirably providing an additional protection against pump motor failure. In yet a further embodiment, in a case following interruption, upset or power failure of pump 100, integrated pressurized seal assembly 102 may desirably provide for gradual reduction of positive pressure within seal chamber 105 such as by providing for closure of backflow valve 109 as pressure in seal chamber declines below a desired minimum pressure, and thereafter by allowing gradual bleed down of pressurized oil in seal chamber 105 through mechanical seals 117, 107, so as to desirably maintain exclusion of a pumped fluid from the seal chamber 105 and oil reservoir 106, for example, thereby protecting bearings 108 and pump motor 101, respectively.

In one embodiment of the present disclosure, integrated pressurized seal assembly 102 may further comprise a pressurized oil diffuser (not shown) such as located between oil pump 104 impeller and pressurized seal chamber 105, so as to desirably convert fluid velocity of oil pumped by oil pump impeller 104 to static pressure for pressurizing seal chamber 105 to a desired positive pressure relative to outside ambient fluid pressure. In a particular such embodiment, integrated pressurized seal assembly 102 additionally comprises a bearing housing (not shown) within seal chamber 105 and containing shaft bearing 108, wherein the bearing housing includes a diffuser for receiving pressurized pumped oil from oil pump impeller 104 and converting fluid velocity of the pumped oil into static pressure within seal chamber 105, for example. In a further such embodiment, the diffuser may additionally include at least one of splitting and guiding channels (not shown) oriented to divert and/or direct additional pumped oil flow into pressure reducing valve 110 and thereby increasing oil flow to cooling jacket 111, for example. In another optional embodiment, oil pump 104 may additionally comprise one or more vent channels operable to vent a portion of oil pressurized by pump 104 to a sump external to seal chamber 105, such as to desirably reduce overpressure on seal chamber 105, for example.

In another embodiment of the present disclosure, seal chamber 105 may comprise one or more baffles or other suitable flow directing structures (not shown) effective to desirably reduce swirling and/or creation of air pockets or cavitation of pumped oil in the vicinity of seal faces of one or more of upper and lower mechanical seals 107, 117, for example. In an optional embodiment, oil pump 104, such as centrifugal radial impeller oil pump 104 may desirably be oriented in a direction such that an axial thrust load on pump shaft 112 due to oil pump 104 integrated with pump shaft 112 may desirably act in a direction opposite to one or more other axial thrust loads on pump shaft 112, such as opposite to an axial thrust load due to wet end 103 of pump 100, such as to desirably reduce imbalance in axial thrust loads on shaft 112 which may be borne by bearings 108, 118, for example. In another embodiment directed to pumps used for submersion at significant depths in a pumped fluid, integrated pressurized pump seal assembly 102 may desirably comprise a pressure compensation device (not shown) which is operable to desirably control or increase an operational oil pressure in pressurized seal chamber 105, such as to maintain a positive pressure of seal chamber 105 over an ambient pumped fluid pressure outside seal chamber 105. In another optional embodiment, oil reservoir 106 may additionally comprise an air relief valve (not shown), such as to relieve any aid in reservoir 106, such as may otherwise undesirably result in airlock of the oil reservoir/pump/seal chamber oil pressurization assembly of the assembly 102. In an alternative such embodiment, an air relief valve may also assist in adding oil to oil reservoir 106 such as to allow release of air from oil reservoir 106 when filling and/or refilling the assembly 102 with oil, for example. In yet another alternative embodiment, an air relief valve may admit air to reservoir 106 if desired, for example.

In one embodiment of the present disclosure, a rotary fluid (and/or slurry) pump 100 comprising an integrated pressurized pump shaft seal assembly 102 is provided, wherein the integrated pressurized seal assembly 102 is configured or otherwise adapted for use with a desired pump motor 101 and impeller assembly/wet end 103 to desirably provide a pressurized seal assembly to protect bearings 108 and pump motor 101, for example. In yet another embodiment of the present disclosure, a method of using a rotary fluid (and/or slurry) pump 100 is provided where the pump 100 comprises an integrated pressurized pump shaft seal assembly 102, and operation of the pump 100 such as by rotation of pump shaft 112 by pump motor 101 also directly rotates integrated oil pump 104 so as to pressurize oil in seal chamber 105 for desirably preventing and/or reducing seal failure in pump 100. In a further embodiment, a method of preventing seal failure is provided, comprising providing a rotary fluid (and/or slurry) pump 100 comprising an integrated pressurized pump shaft seal assembly 102, and operation of the pump 100 such as by rotation of pump shaft 112 by pump motor 101 also directly rotates integrated oil pump 104 so as to pressurize oil in seal chamber 105 for desirably preventing and/or reducing ingress of external fluids into seal chamber 105 and/or mechanical seals 107, 117.

Figure 2:
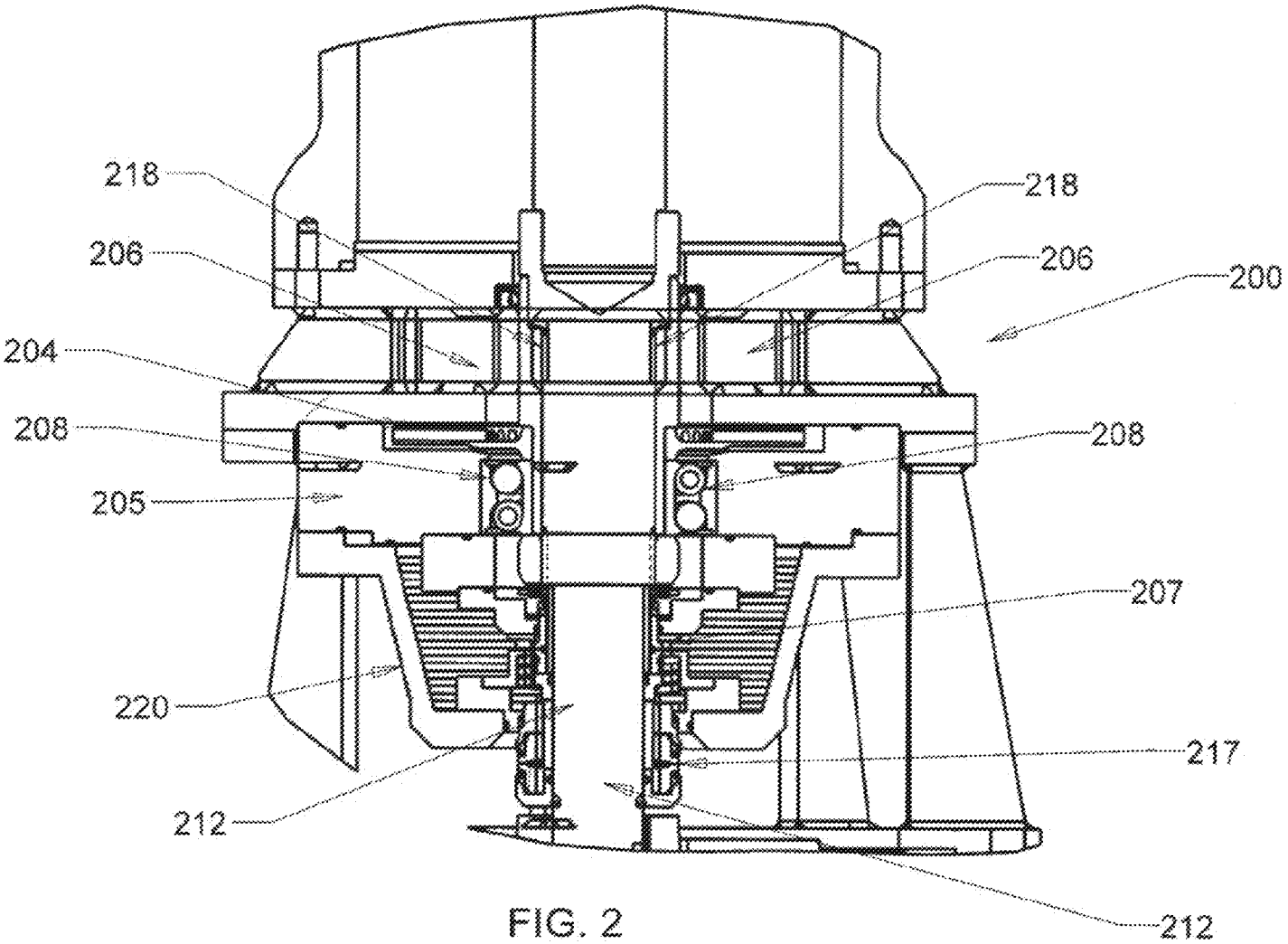
FIG. 2 is a longitudinal cross sectional view of an integrated pressurized pump shaft seal according to an embodiment of the present disclosure, which is part of a pump apparatus comprising the same, according to a further embodiment of the disclosure.

Referring now to FIG. 2, a longitudinal cross sectional view of a portion of a rotary fluid (and/or slurry) pump comprising an integrated pressurized pump shaft seal assembly 200 is shown. Similar to the embodiments of the present disclosure shown in schematic form in FIG. 1, integrated pressurized pump shaft seal assembly 200 comprises an integrated centrifugal oil pump 204 directly attached to and integrated with pump shaft 212, and situated between an oil reservoir 206 above integrated oil pump 204, and a seal chamber 205 containing pump shaft bearing 208 and situated below integrated oil pump 204. Integrated oil pump 204 is operable to pump oil from oil reservoir 206 to seal chamber 205 to pressurize seal chamber 205 at a positive pressure greater than an ambient pumped fluid pressure outside seal chamber 205. In one embodiment, the integrated pressurized pump shaft seal assembly 200 comprises a dual mechanical seal arrangement comprising an upper mechanical seal 207, and a lower mechanical seal 217, which each comprise two mechanical seal faces engaged in rotational sealing contact with each other to provide a mechanical shaft seal on pump shaft 212. Mechanical seals 207, 217 may comprise any suitable mechanical seal design and/or materials, such as comprising silicon and/or tungsten carbide seal surfaces, for example, and in one embodiment of the present disclosure, upper and lower mechanical seals 207, 217 may each be provided as a cartridge mechanical seal, for example. Integrated pressurized pump shaft seal assembly 202 including mechanical seals 207 and 217 and further comprising a seal chamber 205 containing oil (or any other suitable seal and/or bearing lubricating fluid for example) may desirably be pressurized at a positive pressure above the ambient or sump pressure outside the seal chamber 205 and may therefore desirably prevent a pumped slurry, fluid or other contaminants from outside seal chamber 205 from entering seal chamber 205 containing and protecting the lower shaft bearings 208, and oil reservoir 206, and desirably also protecting the pump motor located above the oil reservoir 206, for example.

In a particular embodiment, oil pump 204 may comprise a radial hole centrifugal impeller pump, and may be directly attached to and integrated with pump shaft 212 such as by retaining oil pump 204 to shaft 212 by means of a retaining locknut, for example. In a further such embodiment, integrated oil pump 204, pump shaft bearings 208, and optionally also a shaft sleeve (not shown) may be attached to pump shaft 212 by a common retaining locknut, for example, such that rotation of the pump shaft 212 by a pump motor (not shown) directly rotates integrated oil pump 204. In a further embodiment, pump shaft bearings 208 may be at least substantially open to seal chamber 205, such that oil or another suitable lubricating fluid pressurized in chamber 205 by integrated oil pump 204 may provide lubrication to bearings 208. In a further such embodiment, bearings 208 may comprise a bearing housing (not shown) which may desirably comprise a bearing oil pool or reservoir which may retain residual oil to lubricate bearings 208 even if seal chamber 205 loses pressure and is at least partly drained of oil, such as in the event of failure of mechanical seals 207, 217, for example. In a particular embodiment, integrated pressurized pump shaft seal assembly 200 may also comprise at least one lip seal 218 situated between oil reservoir 206 and pump shaft 212 which may desirably provide a further seal barrier between integrated pressurized pump shaft seal assembly 200 and a pump motor above assembly 202, and may desirably provide further protection for a pump motor against ingress of external fluids following failure of both mechanical seals 207, 217, for example.

In one embodiment, seal chamber 205 may further comprise a seal chamber housing 220 such as to support mechanical seals 207, 217, and enclose seal chamber 205 and pump shaft bearings 208. In one such embodiment, seal chamber housing 220 may desirably comprise a suitable durable material with desirably high thermal conductivity, such as to advantageously provide for effective heat transfer from pressurized oil inside seal chamber 205 to a pumped fluid (such as a pumped fluid in a sump, for example), which may desirably provide for cooling of the pressurized oil inside chamber 205, for example.

Figure 3:
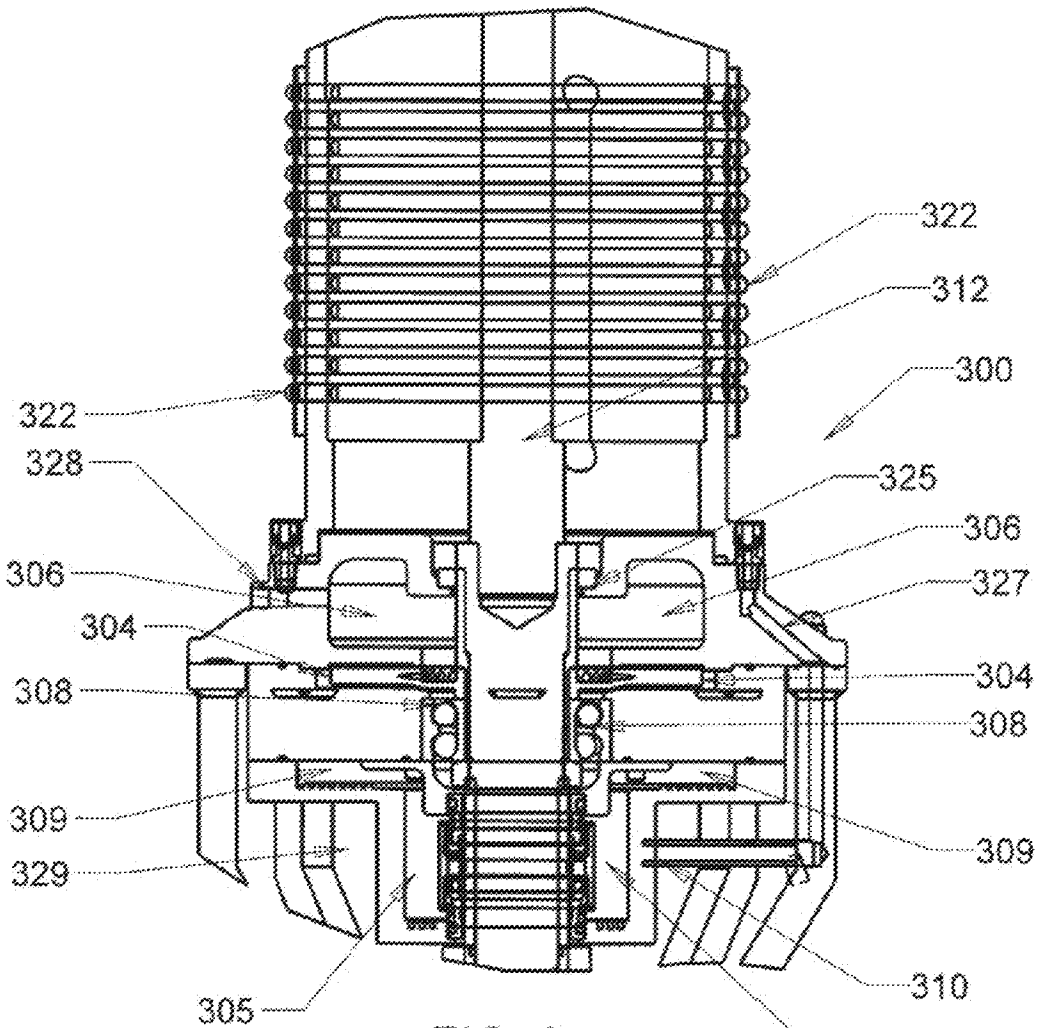
FIG. 3 is an inset longitudinal cross sectional view of internal details of an integrated pressurized pump shaft seal according to an embodiment of the present disclosure, and part of a pump apparatus comprising the same, according to a further embodiment of the disclosure.

Referring now to FIG. 3, an inset longitudinal cross sectional view of internal details of a portion of a rotary fluid (and/or slurry) pump comprising an integrated pressurized pump shaft seal assembly 300 is shown. Similar to the embodiments of the present disclosure shown in and described above in FIGS. 1 and 2, integrated pressurized pump shaft seal assembly 300 comprises an integrated centrifugal oil pump 304 directly attached to and integrated with pump shaft 312, and situated between an oil reservoir 306 above integrated oil pump 304, and a seal chamber 305 containing pump shaft bearing 308 and situated below integrated oil pump 304. Integrated oil pump 304 is operable to pump oil from oil reservoir 306 to seal chamber 305 to pressurize seal chamber 305 at a positive pressure greater than an ambient pumped fluid pressure outside seal chamber 305, for example. In one embodiment, the integrated pressurized pump shaft seal assembly 300 comprises a dual mechanical seal arrangement substantially similar to that shown in FIG. 2 and described above, such as to allow for pressurizing seal chamber 305 with oil (and/or another suitable bearing lubricating fluid for example) at a positive pressure above the ambient or sump pressure outside the seal chamber 305 and may therefore desirably prevent a pumped slurry, fluid or other contaminants from outside seal chamber 305 from entering seal chamber 305 containing and protecting the lower shaft bearings 308, and oil reservoir 306, and desirably also protecting the pump motor located above the oil reservoir 306, for example.

In a particular embodiment, oil pump 304 may comprise a radial hole centrifugal impeller pump and may be directly attached to and integrated with pump shaft 312 such as by retaining oil pump 304 to shaft 312 by means of a retaining locknut, for example. In a further such embodiment, integrated oil pump 304, pump shaft bearings 308, and optionally also a shaft sleeve (not shown) may be attached to pump shaft 312 by a common retaining locknut, for example, such that rotation of the pump shaft 312 by a pump motor directly rotates integrated oil pump 304. In a further embodiment, pump shaft bearings 308 may be at least substantially open to seal chamber 305, such that oil or another suitable lubricating fluid pressurized in chamber 305 by integrated oil pump 304 may provide lubrication to bearings 308. In a further such embodiment, bearings 308 may comprise a bearing housing (not shown) which may desirably comprise a bearing oil pool or reservoir which may retain residual oil to lubricate bearings 308 even if seal chamber 305 loses pressure and is at least partly drained of oil, such as in the event of failure of mechanical seals sealing the bottom of seal chamber 305, for example. In a particular embodiment, integrated pressurized pump shaft seal assembly 302 may also comprise at least one lip seal 325 situated between oil reservoir 306 and pump shaft 312 which may desirably provide a further seal barrier between integrated pressurized pump shaft seal assembly 300 and a pump motor above assembly 300, and may desirably provide further protection for a pump motor against ingress of external fluids following failure of mechanical seals.

In one embodiment of the present disclosure, integrated pressurized seal assembly 300 further comprises a check valve 309, located between integrated oil pump 304 and pressurized seal housing 305. In a particular such embodiment, check valve 309 may desirably be operable to prevent backflow of oil from seal chamber 305 to oil reservoir 306, through integrated oil pump 304, such as may otherwise occur upon shutdown of the pump motor, and may undesirably lead to contamination of oil reservoir 306 following eventual failure of mechanical seals below seal chamber 305, for example. Since mechanical seals are subject to wear and eventual failure upon extended operation of a rotary pump, particularly in harsh operation such as in pumping abrasive slurries, even with the assistance of pressurized seal chamber 305 which may desirably exclude pumped fluid (such as a pumped slurry) from entering mechanical seals during normal operation, check valve 309 may also be operable to close upon detection of failure of a mechanical seal, such as to keep pumped fluid and/or moisture from entering oil reservoir 306, such as through the integrated oil pump 304. In one such embodiment, check valve 309 may comprise a pressure-actuated valve such that the check valve 309 closes if the pressure in the seal chamber 305 decreases below a desired minimum pressure, and whereby such closing of valve 309 may desirably reduce or prevent admission of fluid to oil reservoir 306. In another such embodiment, a sensor (not shown) may be provided that is operable to detect failure of a mechanical seal below chamber 305, and to trigger closure of check valve 309 upon such failure. In another embodiment, a sensor may also be provided that may trigger an alarm or other suitable indication (such as an indicator light or signal for example) to notify a user of the failure of a mechanical seal. In a further optional embodiment, one or more sensors may also be provided to detect one or more of: failure of mechanical seals (not shown); low oil level in oil reservoir 306; water and/or moisture ingress into seal chamber 305; and a drop in oil pressure in seal chamber 305 below a desired minimum level; faults, and such sensor(s) may further be operable to trigger an alarm or other suitable indication to notify a user of one or more of such 10 faults.

In another embodiment of the present disclosure, the integrated pressurized pump seal assembly 300 may additionally comprise a cooling jacket 322, such as for circulating oil (or other suitable lubricating fluid) from oil reservoir 306 under pressure from oil pump 304, to cool a pump motor (desirably located at least partially within cooling jacket 322). In one such embodiment, such as for use in a semi-submerged pump, oil from oil reservoir 306 may be pumped into seal chamber 305 by integrated oil pump 304 driven by rotation of pump shaft 312, to pressurize seal chamber 305 at a positive pressure above an outside ambient fluid pressure, and a portion of oil in seal chamber 305 may be admitted through a pressure reducing valve 310 (which may normally be open) to circulate through cooling jacket 322 surrounding at least a portion of the pump motor. Such circulation of oil from seal chamber 305 through pressure reducing valve 310 and thereafter through a cooling oil supply conduit 327 to cooling jacket 322, then through returning to oil reservoir 306 through cooling oil return conduit 328, before returning to seal chamber 305 under pressure from integrated oil pump 304, may desirably circulate heat from the pump motor to seal chamber 305, where the circulated oil may be cooled by typically cooler surrounding ambient pumped fluid located outside of the seal chamber 305, such as in sump 329, for example. In one such embodiment, pressure reducing valve 310 may desirably be configured to maintain a desired minimum positive pressure in seal chamber 305 such as by limiting and/or controlling flow of oil through pressure reducing valve 310 and cooling jacket 322, for example, to maintain pressurization of seal chamber 305 at or above the desired minimum positive pressure. In a particular embodiment, seal chamber 305 and any optional surrounding housing around seal chamber 305 (not shown) may desirably be comprised of a suitably thermally conductive material, such as aluminum for example, so as to desirably allow dissipation of heat from oil in seal chamber 305 (and optionally also from oil reservoir 306) to typically cooler pumped fluid located outside of the chamber 305 and/or housing, such as a pumped fluid in sump 329. In one such embodiment, walls of seal chamber 305 and/or a further optional seal chamber housing may additionally include cooling fins or other suitable structures such as to improve heat dissipation from the oil chamber 305 to an ambient fluid outside of the chamber.

Similar to the check valve 309 described above, pressure reducing valve 310 may also be operable to close upon detection of failure of a mechanical seal below seal chamber 305, such as to keep pumped fluid and/or moisture from entering cooling jacket 322. In one such embodiment, a sensor (not shown) may be provided that is operable to detect failure of a mechanical seal below seal chamber 305, and to trigger closure of pressure reducing valve 310 upon such failure. In another embodiment, a sensor may also be provided that may trigger an alarm or other suitable indication (such as an indicator light or signal for example) to notify a user of the failure of a mechanical seal. In an optional, an optional oil filter (not shown) may be provided such as between the seal chamber 305 and the check valve 309, or between the oil reservoir 306 and the oil pump 304, for example, to desirably provide additional protection against contamination of the oil in seal chamber 305 and provide increased bearing life of bearings 308.

In certain applications, it is desirable to add the integrated pressurized pump shaft seal assembly to a submersible pump design without increasing the power rating of the submersible pump's motor, so as to reduce the overall cost of the pump. The challenge presented is to design the integrated pressurized pump shaft seal assembly so as to minimize the additional power draw on the pump's motor caused by rotating the centrifugal oil pump impeller, while at the same time sufficiently pressurizing the seal chamber so as to achieve a positive pressure within the seal chamber above the ambient pressure of the external fluids, and achieving that positive pressure with only the centrifugal oil pump impeller, and not, for example, by the use of a mechanical piston or a pressurized gas. Although conventional engineering knowledge implies that simply increasing the size of the centrifugal oil pump impeller would produce a sufficient amount of positive pressure, this solution does not solve the problem of providing an integrated pressurized pump shaft seal assembly on a submersible pump without increasing the size of the pump casing or the pump motor.

The applicant found that achieving this goal requires a combination of increasing the efficiency of the centrifugal oil pump impeller by reducing as much as possible any frictional losses in the flow of the pumped oil, combined with the addition of integrated, internal diffusion and volute components to efficiently convert the kinetic pressure of the pumped oil to a static pressure within the seal chamber as the oil flows from the oil pump impeller to the seal chamber. As will be appreciated by a person skilled in the art, the applicant encountered challenges in designing the integrated, internal diffusion and volute components due to the limited space available inside the existing pump casing.

Figure 4A:
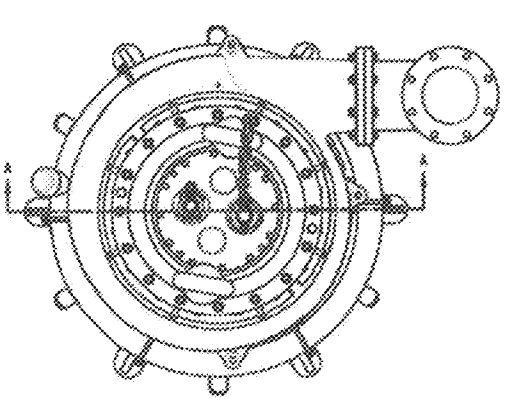
FIG. 4A is a top plan view of a pump apparatus comprising an integrated pressurized pump shaft seal assembly, according to a further embodiment of the present disclosure.
Figure 4B:
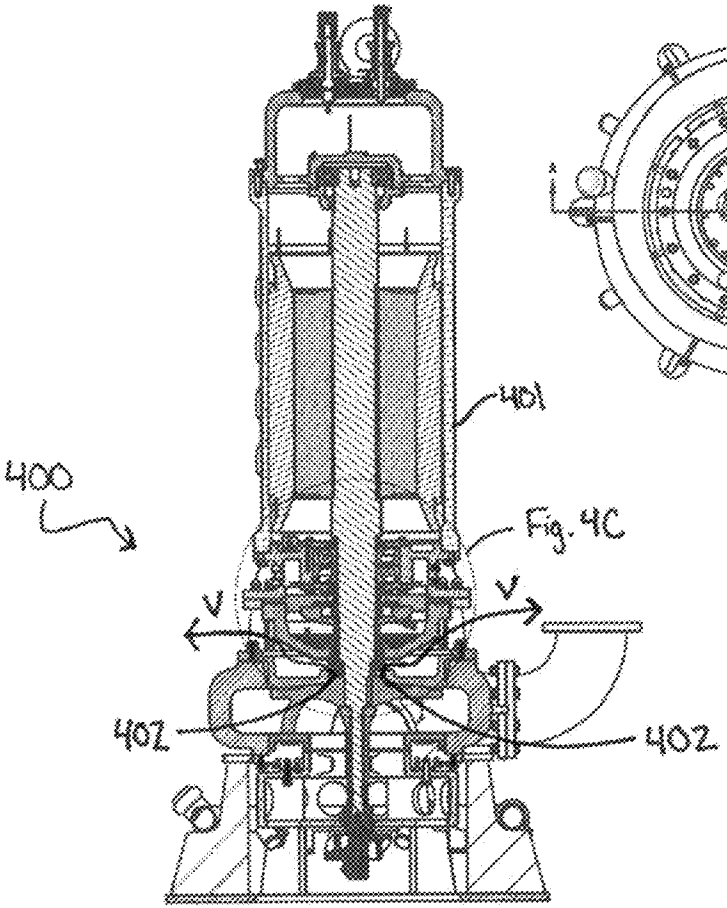
FIG. 4B is a cross sectional view of the pump apparatus of FIG. 4A, taken along the line A-A of FIG. 4A.
Figure 4C:
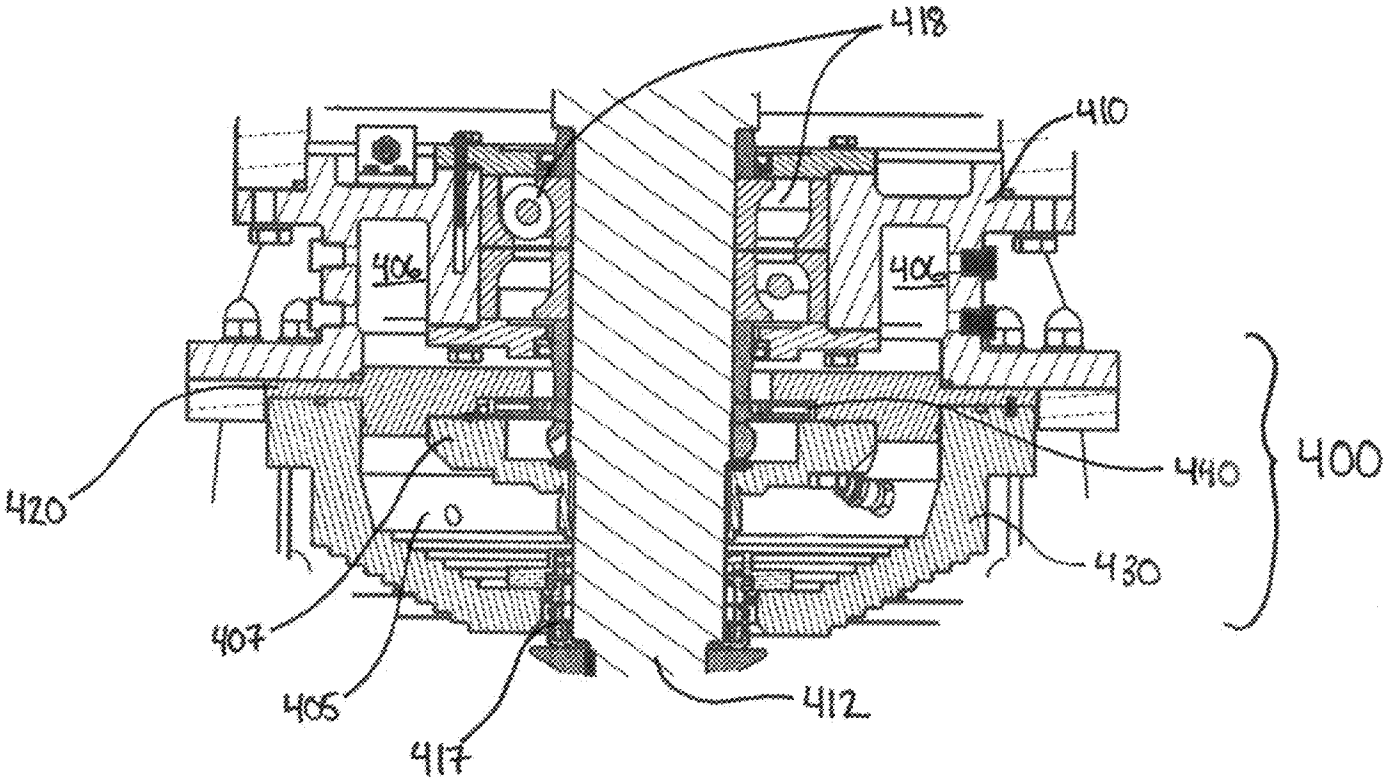
FIG. 4C is a close up view of a portion of the pump apparatus and integrated pressurized pump shaft seal assembly shown in FIG. 4B.

In the following paragraphs, the design features of an integrated pressurized pump shaft seal assembly for the embodiments introduced above will now be described, with reference to FIGS. 4A through 14D. As shown in FIGS. 4A through 4C, a pressurized pump shaft seal assembly 400 comprises an oil reservoir 406, which is at an ambient pressure substantially equal to or less than the ambient pressure of the surrounding fluid outside of the pump casing 401. The oil reservoir 406 is in fluid communication with the centrifugal oil pump impeller 440. As shown in FIGS. 4C and 8B, the centrifugal oil pump impeller 440 has a plurality of outlets 444 that are in fluid communication with a diffusion element 420, the diffusion element 420 being positioned adjacent to the centrifugal oil pump impeller 440, the diffusion element including an internal diffusion bore 424 (see FIG. 6A), which is in fluid communication with an internal volute element. The internal volute element is integrated into the mechanical seal housing 430, which mechanical seal housing also defines seal chamber 405, as will be further explained below. The diffusion element and internal volute element, in some embodiments, together serve to diffuse the pumped volume of oil as it exits the centrifugal oil impeller and flows towards the seal chamber 405, so as to convert the kinetic energy of the pumped oil into a static pressure. The embodiment of the integrated pressurized pump shaft seal assembly illustrated in FIGS. 4A through 10C is adapted for a pump frame and a pump motor rated between 300 horsepower and 600 horsepower.

Figure 5B:
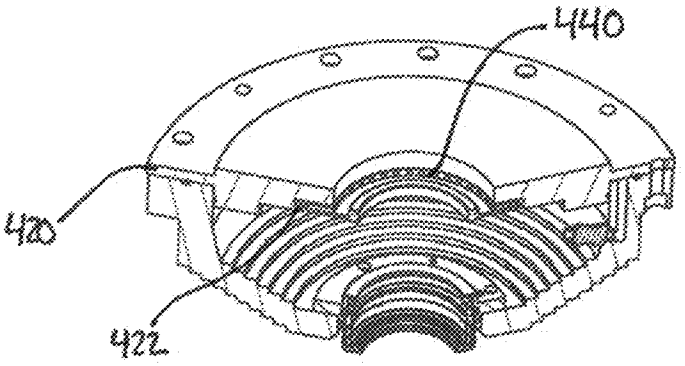
FIG. 5B is the cross sectional perspective view of the integrated pressurized pump shaft seal assembly illustrated in FIG. 5A with the bearing housing adapter removed.

As best viewed in FIGS. 5A and 5B, the oil reservoir 406 is defined by an annular cavity between the bearing housing adapter 410 and diffusion element 420, which in the embodiment illustrated in FIGS. 4A to 11D, is a diffuser 420. Oil from the oil reservoir 406 flows into an inlet 442 of the centrifugal oil pump impeller 440, and then the plurality of outlets 444 of the centrifugal oil pump impeller 440 are in fluid communication with an inlet 422 of the diffusion element 420.

Figure 8A:
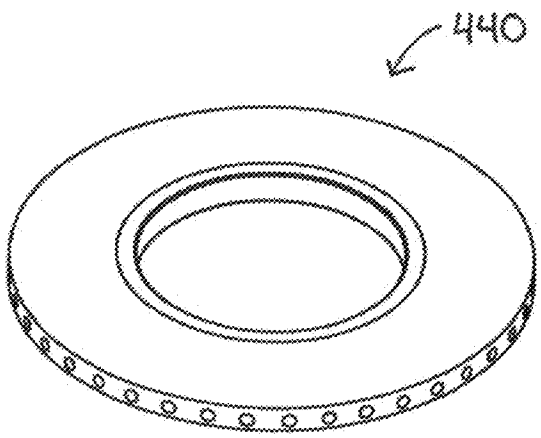
FIG. 8A is a bottom perspective view of the centrifugal oil pump impeller shown in FIG. 4C.
Figure 8B:
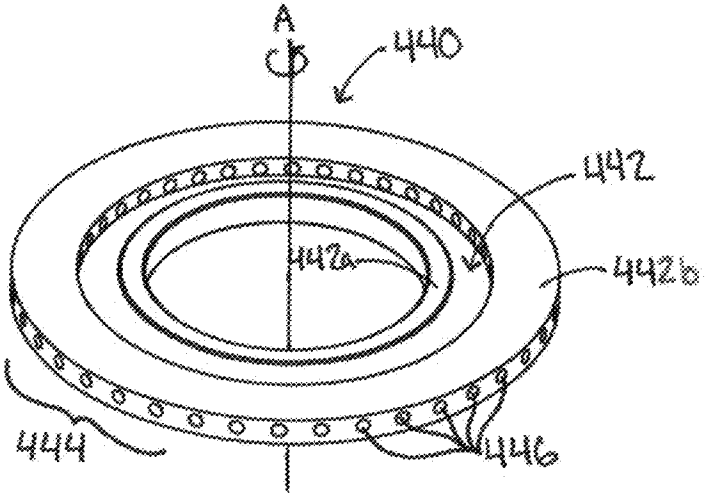
FIG. 8B is a top perspective view of the centrifugal oil pump impeller shown in FIG. 4C.
Figure 8C:
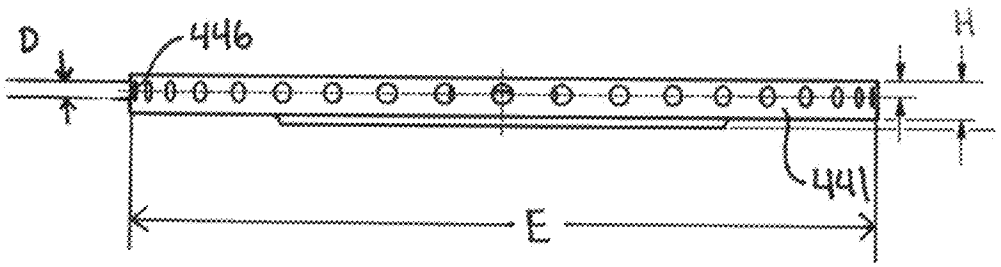
FIG. 8C is a side elevation view of the centrifugal oil pump impeller shown in FIG. 4C.

As illustrated in FIGS. 8A to 8C, the centrifugal oil pump impeller 440 may be a radial hole impeller, wherein the inlet 442 of the impeller comprises an annular void defined between an inner ridge 442*a* and an outer ridge 442*b*. The outer ridge 442*b* comprises a plurality of radial impeller bores 446 which are drilled radially outwardly from and perpendicular to an axis of rotation A of the impeller 440. Thus, the volume of oil to be pumped from the oil reservoir 406 into the seal chamber 405 enters the inlet of the impeller 442 and flows through the plurality of bores 446, thereby exiting the bores 446 at the plurality of outlets 444 of the impeller 440. As may be seen in FIGS. 8A through 8C, each bore of the plurality of bores 446 may be a linear bore that is perpendicular to the axis of rotation A of the impeller 440, which the applicant has found to be an efficient design for the oil pump impeller in this particular application as it minimizes frictional losses as the oil travels through the impeller.

Additionally, further optimizing the efficiency of the oil pump impeller involved increasing a diameter D of the bores 446 and spacing the plurality of bores 446 as close together as feasible so as to fit as many bores 446 as possible on the impeller, while maintaining the structural integrity of the impeller 440 and also taking ease of manufacturing into consideration. By way of example, without intending to be limiting, a height H of the impeller blade 441 may be equal to 14 mm, whereas the diameter D of each for the plurality of bores 446 may be 7 mm. The outer diameter E of the impeller 440 is 270 mm, and the plurality of bores 446 includes forty (40) bores in the illustrative example shown at FIGS. 8A to 8C. It will be apparent to a person skilled in the art that different pump sizes will require different sizes of oil pump impellers, and that the measurements provided herein are not intended to be limiting in any way; that said, the applicant has found that when designing integrated oil pump impellers for different pumps, the general principle of increasing the diameter of bores and number of bores in the centrifugal oil pump impeller 440 will lead to an increased efficiency of the oil pump impeller. It will also be appreciated by a person skilled in the art that, as a result of the limited space available inside a pump casing, the height H of the impeller blade 441 is necessarily constrained, and it is desirable to minimize the height H of the impeller blade 441 so as to conserve the limited space available inside the pump casing.

Figure 6A:
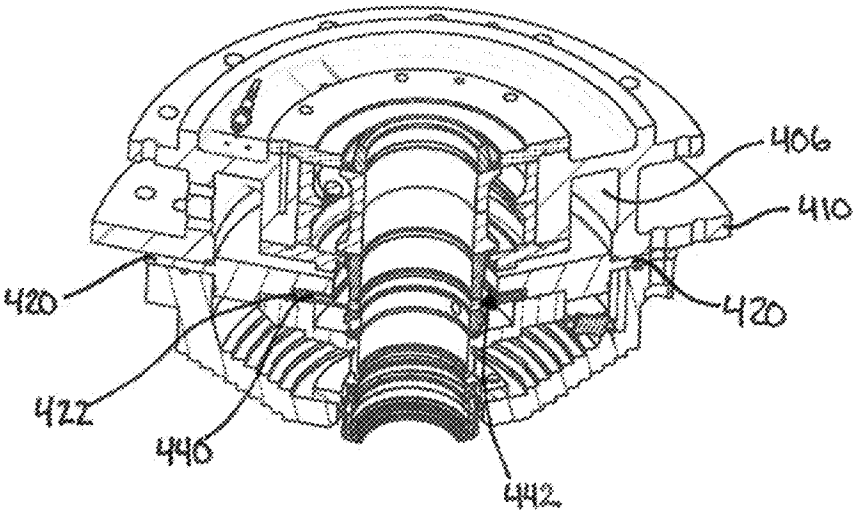
FIG. 6A is a cross sectional view of the centrifugal oil pump impeller, diffusion element and mechanical seal housing of the integrated pressurized pump shaft seal assembly shown in FIG. 4C, taken along line E-E of FIG. 6B.
Figure 6B:
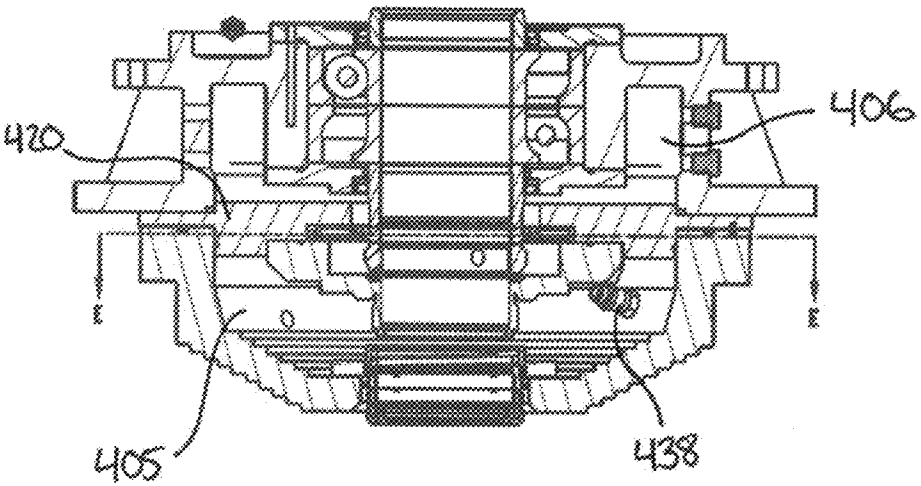
FIG. 6B is a further cross sectional view of the integrated pressurized pump shaft seal assembly shown in FIG. 4C.
Figure 6A:
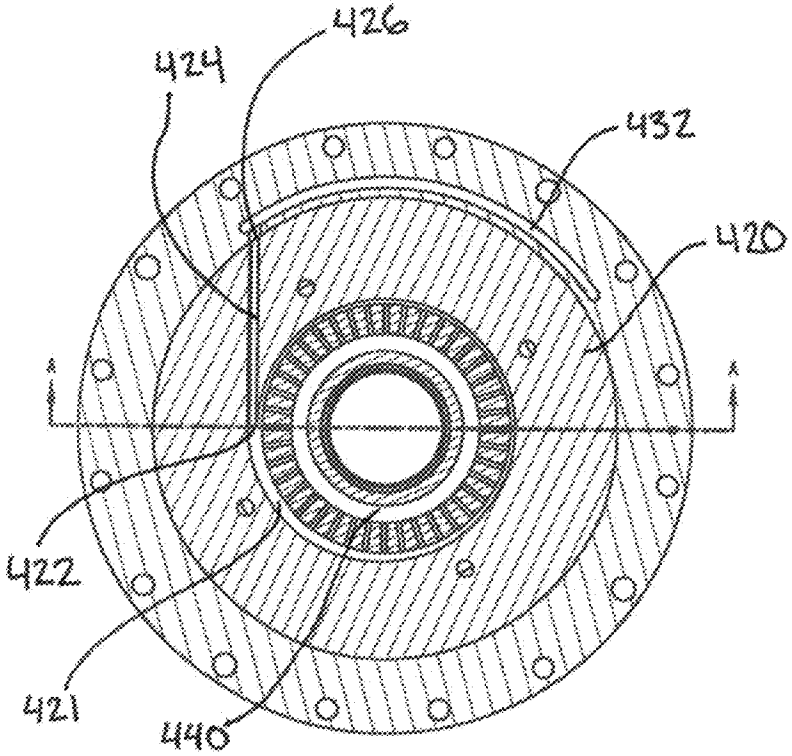
Figure 7A:
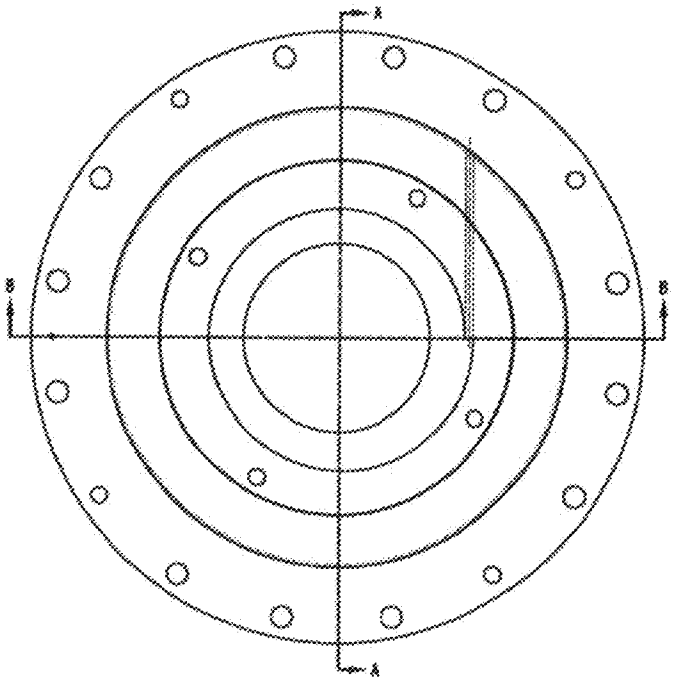
FIG. 7A is a top plan view of the diffusion element of the integrated pump shaft seal assembly shown in FIG. 4C.
Figure 7B:
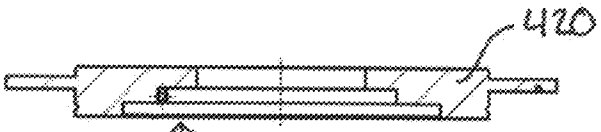
FIG. 7B is a cross sectional view of the diffusion element taken along the line B-B of FIG. 7A.
Figure 7C:
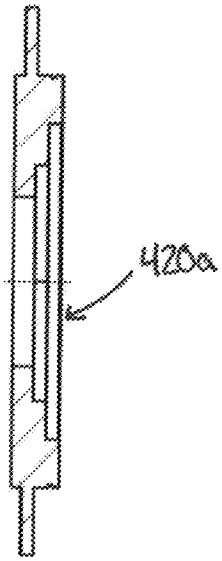
FIG. 7C is a cross sectional view of the diffusion element taken along the line A-A of FIG. 7A.

As shown in FIG. 6A, as the pumped oil exits the impeller 440, it enters a diffusion element 420, which in the embodiment illustrated at FIGS. 4A to 11D is called a diffuser. As best shown in FIGS. 6A and 6B, the diffuser 420 comprises an internal diffusion bore 424 which extends from inlet 422 of the diffuser 420 to the outlet 426 of the bore 424, which outlet 426 is in fluid communication with an axially vertical spiral volute diffusion chamber 432. The internal diffusion bore 424 may be linear, such as shown in FIG. 6A, for ease of manufacturing; however, this is not intended to be limiting, and a non-linear internal diffusion bore may also work, provided the friction losses are minimized as the oil travels through a non-linear diffusion bore. The internal diffusion bore contributes to diffusing the pumped oil while minimizing friction losses, as the volume of pumped oil travels from centrifugal oil pump impeller 442 to the seal chamber 405. Additionally, the diameter of the diffusion bore 424 is sized so as to restrict excessive flow of oil, which advantageously contributes to minimizing the power draw on the motor caused by rotation of the oil pump impeller. Because the diffusion of the pumped oil must occur efficiently within a very short flow path distance in FIG. 5A, advantageously the diffusion element 420 and the internal volute diffusion chamber may contribute to the efficient conversion of the kinetic energy of the pumped oil volume into a static pressure as it arrives in the seal chamber 405.

An additional feature of the diffuser 420, in some embodiments of the present disclosure, includes a spiral passageway 421, which also contributes to the diffusion of the pumped oil as it exits the centrifugal oil pump impeller 440 and travels towards the inlet 422 of the diffusion element 420. As best viewed in FIG. 6A, the spiral passageway 421 is located on a recessed surface 420*a* of the diffuser 420, and the width of the spiral passageway 421 increases as it approaches inlet 422 of the internal diffusion bore 424, which serves to reduce the velocity of the pumped oil as it enters internal diffusion bore 424.

Referring again to FIG. 4C, as the pumped oil volume leaves the outlet 426 of the diffuser 420, it then enters an axially vertical spiral volute diffusion chamber 432 which is integrated into the mechanical seal housing 430. Advantageously, in some embodiments, integrating the volute diffusion chamber 432 into the mechanical seal housing 430 conserves the amount of space required for implementing an integrated volute element within the pump seal casing, and may also reduce the costs of manufacturing.

Figure 9B:
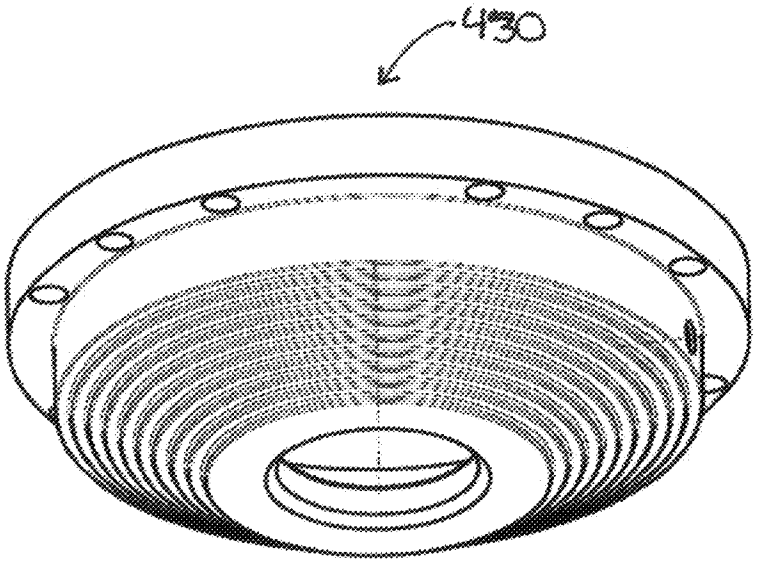
FIG. 9B is a bottom perspective view of the mechanical seal housing shown in FIG. 4C.
Figure 9A:
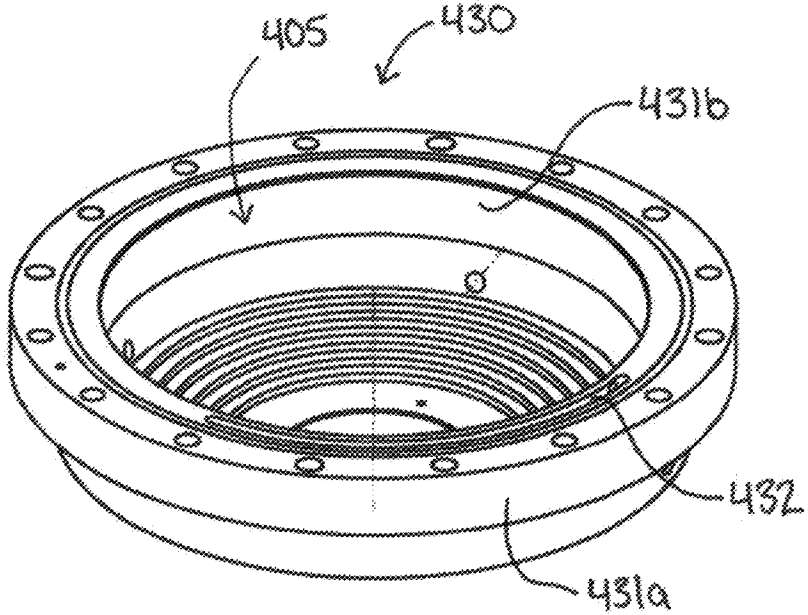
FIG. 9A is a top perspective view of the mechanical seal housing shown in FIG. 4C.
Figure 10B:
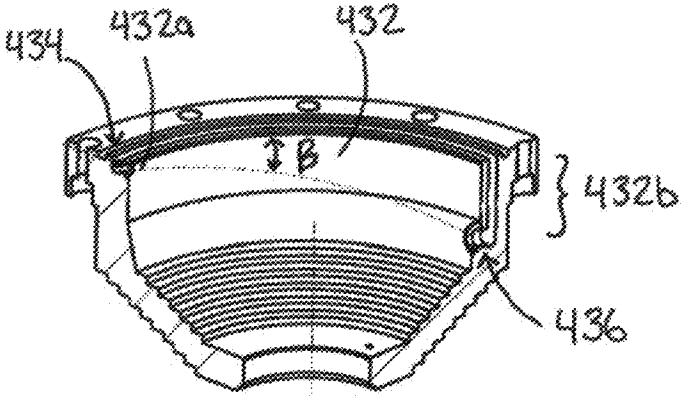
FIG. 10B is a cross sectional perspective view of the mechanical seal housing shown in FIG. 4C, taken along line M-M of FIG. 10A.
Figure 10C:
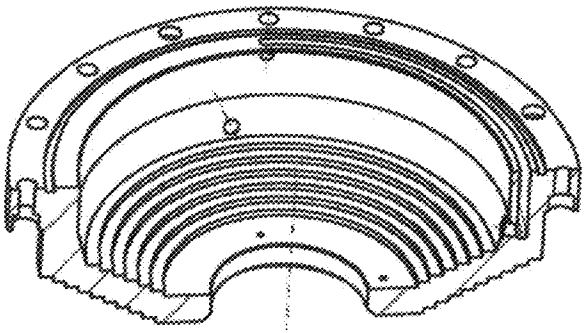
FIG. 10C is a cross sectional perspective view of the mechanical seal housing shown in FIG. 4C, taken along line D-D of FIG. 10A.
Figure 10A:
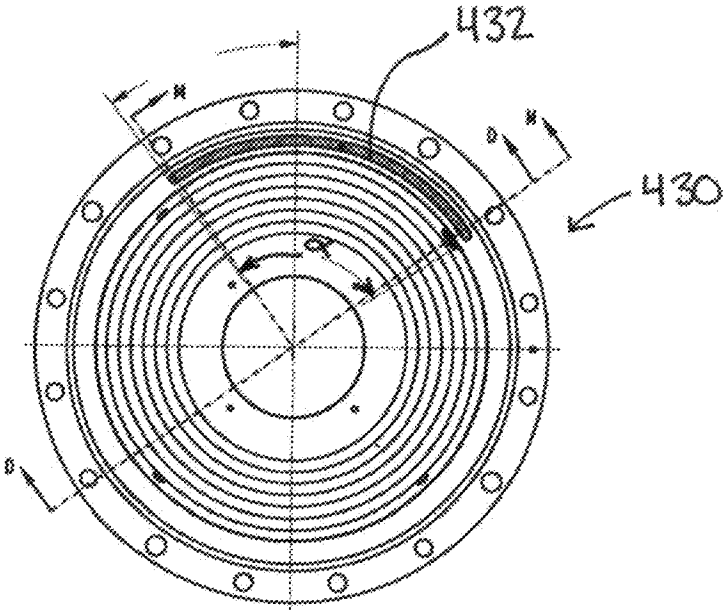
FIG. 10A is a top plan view of the mechanical seal housing shown in FIG. 4C.

Referring to FIGS. 9A and 9B, the mechanical seal housing 430 is an approximately cup-shaped element having an exterior surface 431*a* and an interior surface 431*b*. The volute diffusion chamber 432 is disposed between the exterior surface 431*a* and the interior surface 431*b* of the mechanical seal housing 430. The interior cavity of the mechanical seal housing 430 defines the seal chamber 405 where the mechanical seals 407, 417 are located. As best viewed in FIG. 6A, the outlet 426 of the diffuser 420 feeds into the axially vertical spiral volute diffusion chamber 432. As may be viewed in FIGS. 10A through 10C, the spiral volute diffusion chamber 432 has a short leg 432*a* adjacent the inlet 434 of the chamber, and a long leg 432*b* adjacent the outlet 436 of the spiral volute diffusion chamber 432. In some embodiments, the spiral volute diffusion chamber 432 may have a wrap angle in the range of substantially 90°. For example, in the embodiment shown in FIG. 10A, the wrap angle $\alpha$ of the spiral volute diffusion chamber 432 is substantially 95°; however this is not intended to be limiting and it will be appreciated by person skilled in the art that larger or smaller wrap angles $\alpha$ may also be employed. It will be appreciated that the magnitude of the wrap angle of the volute diffusion chamber 432 is constrained by the height of the mechanical seal housing 430. The applicant has found that the wrap angle $\alpha$ is preferably at least 90° so as to sufficiently diffuse the pumped oil.

Additionally, the spiral volute diffusion chamber 432 has a downward angle $\beta$ of substantially 11° in the illustrated embodiment, although the downward angle of the spiral volute diffusion chamber 432 may vary through the wrap angle $\alpha$ of the chamber 432. The applicant has found that an optimal range for the downward angle $\beta$ is between substantially 8° and 20°. At the outlet 436 of the spiral volute diffusion chamber 432, there is a check valve through which the oil enters into the seal chamber 405. Similar to the function of the check valves 109, 209 and 309 described in the other embodiments disclosed herein, the check valve 438, shown for example in FIG. 6B, allows for oil to enter into the seal chamber 405, but prevents oil from exiting the seal to flow backwards through the centrifugal oil pump impeller and into the oil reservoir, so as to prevent contamination of the oil reservoir in the event of a mechanical seal failure. Additionally, the check valve 438 may be configured to close upon shut down of the pump motor so as to prevent backflow of the oil from the seal chamber through the oil pump impeller to the oil reservoir. Check valve 438 may also be operable to close upon detection of failure of lower mechanical seal 417, such as to keep pumped fluid and/or moisture from entering oil reservoir 406, such as through the oil pump impeller 440. In one such embodiment, check valve 438 may comprise a pressure-actuated valve such that the check valve 438 closes if the pressure in the seal chamber 405 decreases below a desired minimum pressure, and whereby such closing of valve 438 may desirably reduce or prevent admission of fluid to oil reservoir 406. In another such embodiment, a sensor (not shown) may be provided that is operable to detect failure of lower mechanical seal 417, and to trigger closure of check valve 438 upon such failure. In another embodiment, a sensor may also be provided that may trigger an alarm or other suitable indication (such as an indicator light or signal for example) to notify a user of the failure of the lower mechanical seal 417. In a further optional embodiment, one or more sensors may also be provided to detect one or more of: failure of lower or upper mechanical seals 407, 417; low oil level in oil reservoir 406; water and/or moisture ingress into seal chamber 405; and a drop in oil pressure in seal chamber 405 below a desired minimum level; faults, and such sensor(s) may further be operable to trigger an alarm or other suitable indication to notify a user of one or more of such faults.

Returning to FIG. 4C, it may be appreciated that the oil pump impeller 440 is axially sandwiched in between the diffuser 420 and the upper mechanical seals 407. In the embodiment illustrated in FIGS. 4A through 10D, the bearings 418 are located above pump shaft seal assembly 400. However, in other pumps where space inside the pump casing 401 is more limited, it may be necessary to position the bearing 418 beneath pump shaft seal assembly 400, such as shown in the embodiment illustrated in FIGS. 11A to 14D. The embodiment of the integrated pressurized pump shaft seal assembly illustrated in FIGS. 4A through 10C is adapted for a pump frame and a pump motor rated between 10 horsepower and 20 horsepower. Such configurations may be more challenging to manufacture, because utilizing a locknut to secure both the bearings and the oil impeller to the pump shaft means that an interference fit on the inner race of the bearings is not possible, thereby reducing the tolerances on the bearings in order to maintain running accuracy, as compared to conventional pump configurations.

Figure 11A:
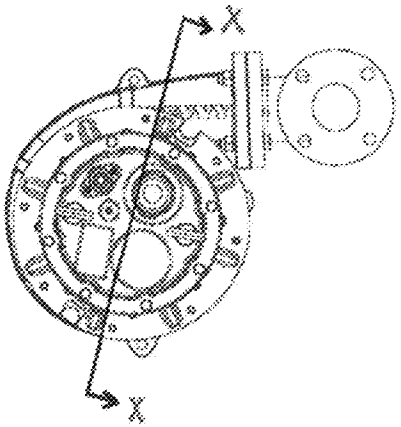
FIG. 11A is a top plan view of a pump apparatus comprising an integrated pressurized pump shaft seal assembly, according to a further embodiment of the present disclosure.
Figure 11B:
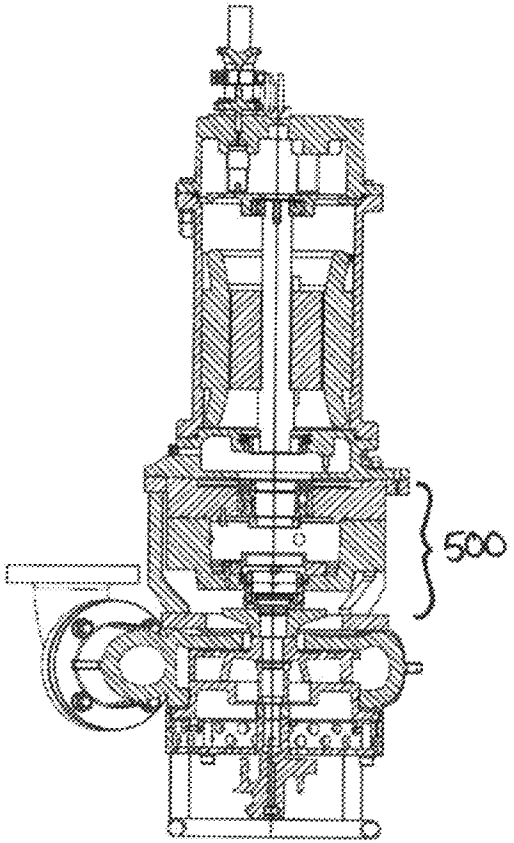
FIG. 11B is a cross sectional view of the pump apparatus of FIG. 11A, taken along line X-X of FIG. 11A.
Figure 11C:
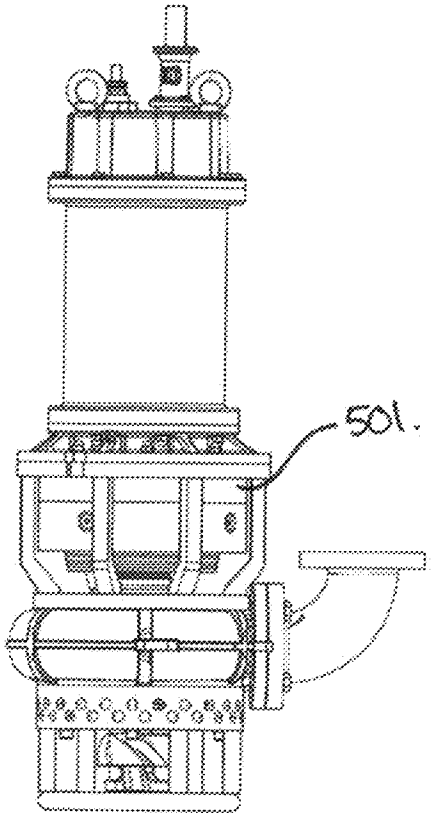
FIG. 11C is a side elevation view of the pump apparatus of FIG. 11A.

As illustrated in FIGS. 11A through 11C, the pressurized pump shaft seal assembly 500 is positioned within pump casing 501. The pressurized pump shaft seal assembly 500 includes an oil reservoir 506, which is at an ambient pressure equal to or less than the ambient pressure of the external fluid surrounding the pump casing, wherein the oil reservoir 506 is defined by a bearing housing adapter 510. In the illustrated embodiment, the centrifugal oil pump impeller 540 is positioned directly beneath the oil reservoir 506, and the impeller 540 is sandwiched between a bearing housing adapter 510 and the bearing housing 511, which houses the bearings 518. In the embodiment illustrated in FIGS. 11A through 11C, the bearing housing 511 comprises the diffusion element 520, as will be further explained below. The bearing housing 511 sits on top of mechanical seal housing, 530, which mechanical seal housing 530 defines seal chamber 505 where the oil is pressurized in order to assist the sealing of the mechanical seals and prevent or subvert the ingress of water through the mechanical seals, in the event of a seal failure.

Figure 12B:
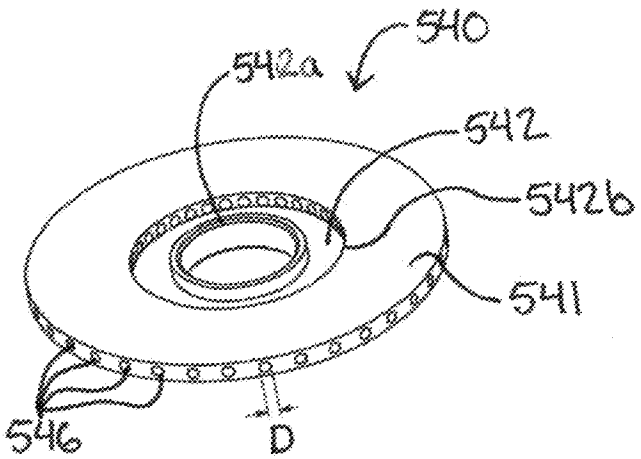
FIG. 12B is a top perspective view of the centrifugal oil pump impeller shown in FIG. 11B.
Figure 12A:
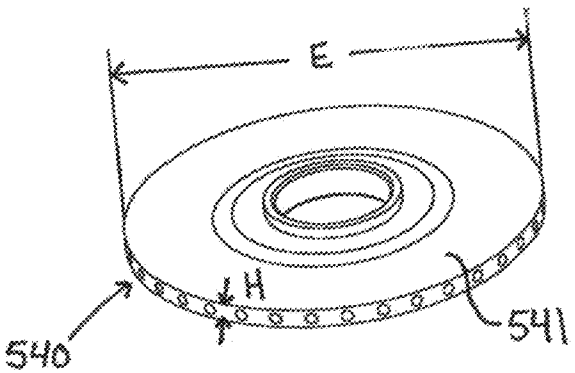
FIG. 12A is a bottom perspective view of the centrifugal oil pump impeller shown in FIG. 11B.
Figure 13A:
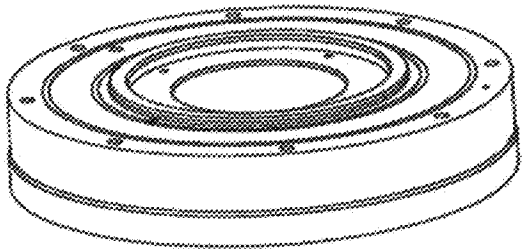
FIG. 13A is a bottom perspective view of the bearing housing shown in FIG. 11B.
Figure 13B:
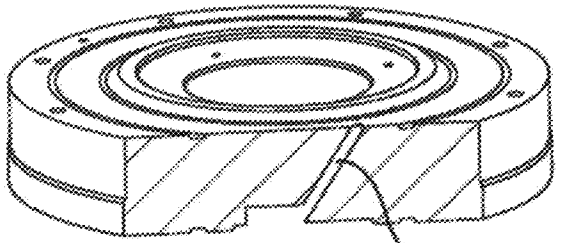
FIG. 13B is a cross sectional view of the bearing housing shown in FIG. 13A.
Figure 13C:
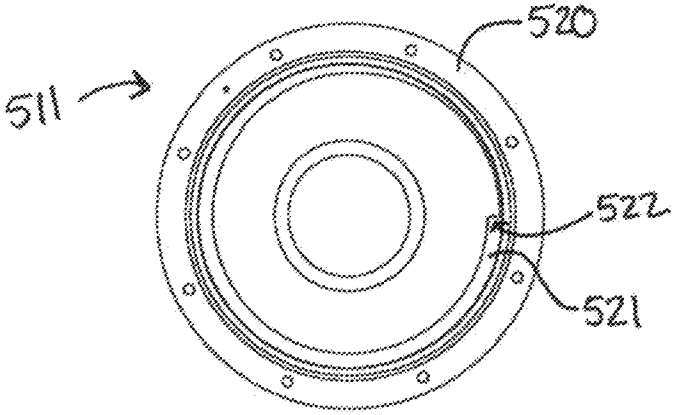
FIG. 13C is a top plan view of the bearing housing shown in FIG. 13A.
Figure 13D:
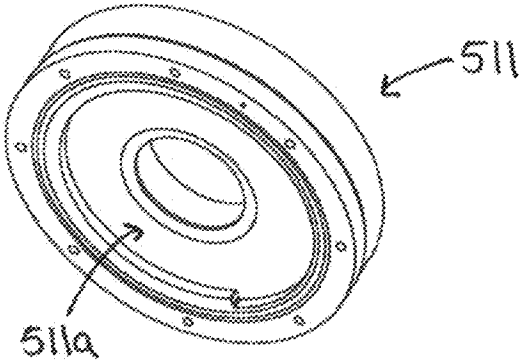
FIG. 13D is a top perspective view of the bearing housing shown in FIG. 13A.
Figure 14C:
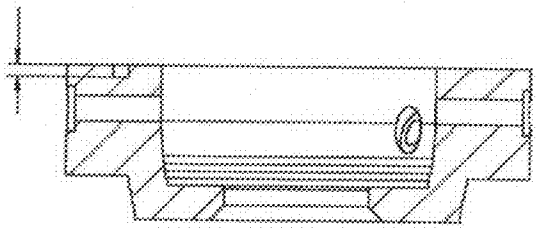
FIG. 14C is a cross sectional view of the mechanical seal housing shown in FIG. 14A.
Figure 14D:
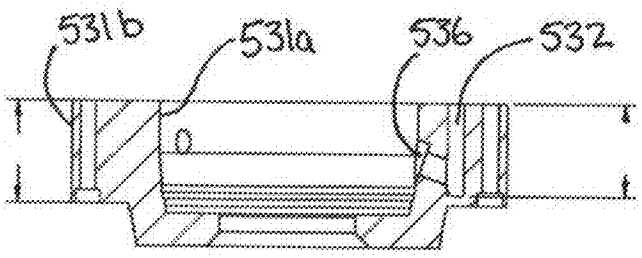
FIG. 14D is a further cross sectional view of the mechanical seal housing shown in FIG. 14A.
Figure 14A:
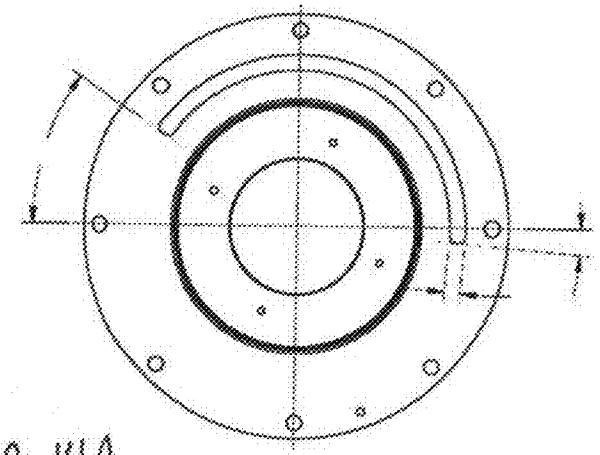
FIG. 14A is a top plan view of the mechanical seal housing shown in FIG. 11B.
Figure 14B:
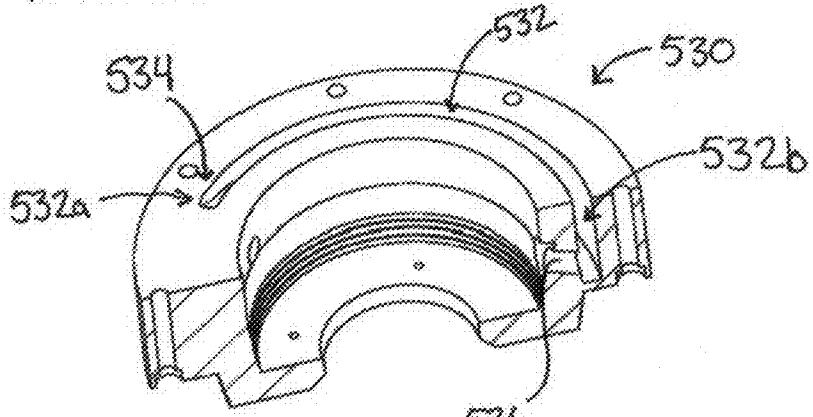
FIG. 14B is a top perspective cross sectional view of the mechanical seal housing shown in FIG. 14A.

As illustrated in FIGS. 12A and 128, the centrifugal oil pump impeller 540 is of a similar design as the centrifugal oil pump impeller 440 of the previously described embodiment. The oil pump impeller 540 is adapted to be mounted or affixed to, so at to be rotated by, the pump shaft 512. The centrifugal oil pump impeller 540 includes an inlet 542, which is an annular void defined between an inner ridge 542*a* and an outer ridge 542*b*. Impeller blade 541 comprises a plurality of radial bores 546 drilled at a 0' entry angle, or in other words perpendicular to the pump shaft 512, and the plurality of impeller bores 546 are substantially linear. As with the design of the impeller in the previous embodiment, the impeller in this embodiment, designed for a smaller pump, also includes bores which are sized to have as large of a diameter D, and as many bores as is practical, taking into account the height H of the impeller blade 541, spacing between the bores and ease of manufacturing considerations. For example, not intending to be limiting, the impeller bores 546 shown in FIGS. 12A and 12B have a diameter of 6 mm, whereas the height H of the impeller blade 541 is 10 mm. Additionally, the impeller has an outer diameter E of 216 mm and there are a total of thirty-six (36) impeller bores 546. However, it will be appreciated that these dimensions are not intended to be limiting, and merely serve as an illustrative example of the design principles taken into consideration for designing an efficient oil pump impeller 540.

As mentioned above with respect to the embodiment shown in FIGS. 11A to 14D, the diffusion element 520 is the bearing housing 511. Similar to the design of diffusion element 420 of the previous embodiment discussed above, in this case, the diffusion element 520 may include a spiral passageway 521 that leads to an inlet 522 of the diffusion element 520, the spiral passageway 521 located on a recessed portion 511*a* of the bearing housing 511, as best viewed in FIG. 13D. The diffusion element 520 further includes a linear internal diffusion bore 524, which provides a pathway for the pumped oil to flow from the centrifugal oil pump impeller 540 to the inlet 534 of the spiral volute diffusion chamber 532 integrated into the mechanical housing 530. For example, it will be apparent to a person skilled in the art with a view to FIG. 11B as compared to FIG. 4C of the previous embodiment, that the orientation and direction of travel of the internal diffusion bore 524 or 424 is informed by the need to move the oil from the oil pump impeller to the volute diffusion chamber. Furthermore, it will be appreciated that some embodiments may not include a diffusion element 520 and an internal diffusion bore 524, for example, in embodiments (not shown) where the outlet of the impeller is located adjacent the inlet 534 of the spiral volute diffusion chamber 532 integrated into a mechanical housing 530 or other pump component, in which case the pumped oil would flow directly from the outlet of the oil pump impeller to the adjacent inlet of the spiral volute diffusion chamber.

With reference to FIGS. 14A to 14D, it may be seen that the mechanical seal housing 530 comprises an interior surface 531*a* and an exterior surface 531*b*, between which surfaces 531*a*, 531*b* the spiral volute diffusion chamber 532 is positioned. Similar to the spiral volute diffusion chamber 432 of the previous embodiment, as shown in FIG. 4B, the spiral volute diffusion chamber 532 illustrated in FIG. 14B includes a short leg 532*a* adjacent the inlet 534 and a long leg 532*b* adjacent the outlet 536 of the spiral volute diffusion chamber 532. Because the volume of the spiral volute diffusion chamber 532 increases from the inlet 534 to the outlet 536 of the chamber, the velocity of the pumped oil flowing through the chamber 532 decreases and the static pressure increases. The volute diffusion chamber outlet 536 into the seal chamber 506 includes a check valve 538 which allows oil to flow through the check valve 538 and into the seal chamber 506, but prevents backflow of the oil from the seal chamber 506 through the check valve 538 and back to the oil reservoir 506.

As will be appreciated by a person skilled in the art, the embodiments described above and illustrated in FIGS. 4A through 14D share in common the features of a diffusion element and a volute diffusion element, which provide integrated diffusion and volute diffusion chambers for diffusion of the pumped oil flowing from the centrifugal oil pump impeller to the seal chamber. As previously mentioned, some embodiments (not illustrated) may not include a diffusion bore leading from the outlet of the oil pump impeller to the inlet of the volute diffusion chamber, where the outlet of the oil pump impeller is adjacent the inlet of the volute diffusion chamber. However, for embodiments such as those illustrated in FIGS. 4A through 14D, which do include a diffusion bore for transporting the pumped oil from the oil pump impeller to the volute diffusion chamber, the diffusion element and diffusion bore advantageously contribute to the diffusion of the pumped oil.

Figure 11E:
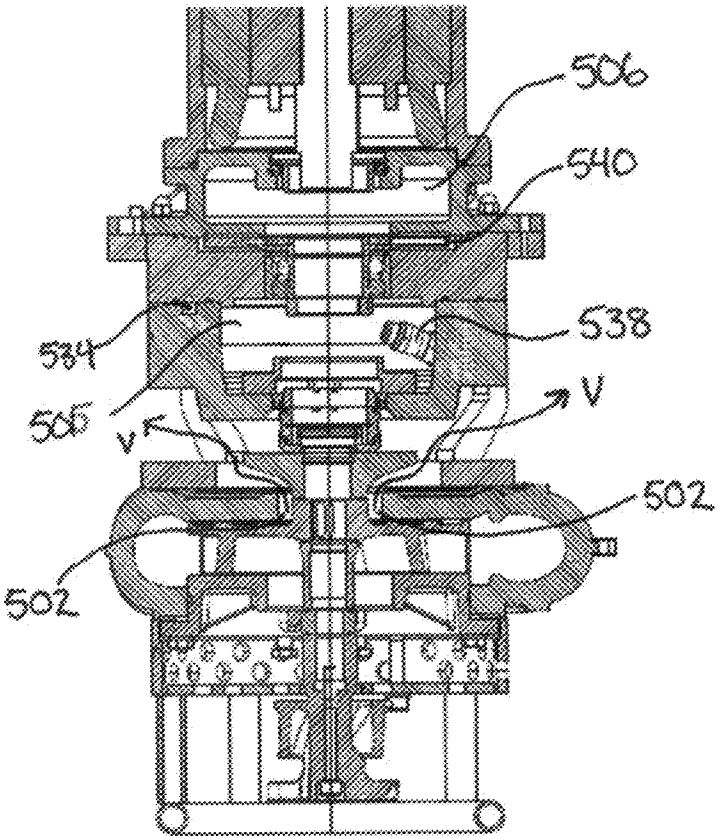
FIG. 11E is a close up view of a further cross sectional view of the pump apparatus of FIG. 11A.
Figure 11D:
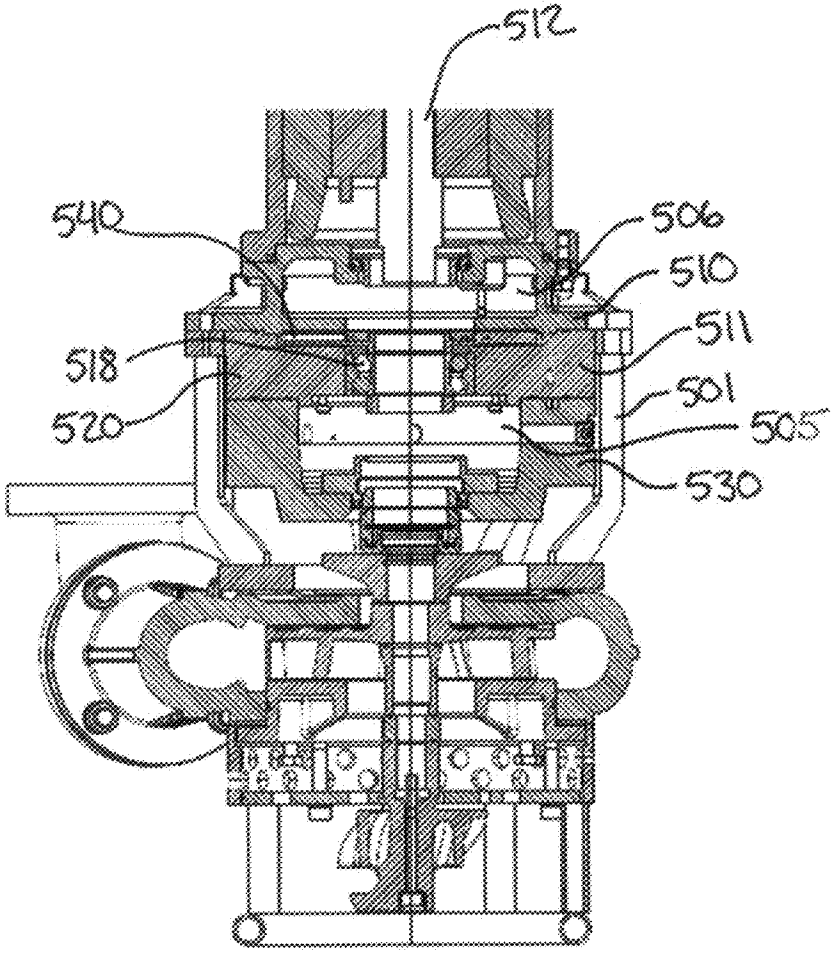
FIG. 11D is a close up view of a further cross sectional view of the pump apparatus of FIG. 11A.

In some embodiments, the wet end of the pump incorporating the integrated pressurized pump shaft seal assembly described herein preferably includes an open stool that comprises the wet end vent 402 and 502, as best viewed in FIGS. 4B and 11E, respectively. The flow path of the vented pumped fluid is represented by arrows V. Providing a large opening for the wet end, as compared to relatively smaller vent holes in prior art submersible pump designs, advantageously reduces the additional pressure produced by the wet end pump impeller, which pressure produced by the pump impeller would otherwise add to the pressure of the external fluid acting against the mechanical seals. In prior art submersible pumps having relatively smaller vent holes or openings, there is a possibility that such vent holes or openings may become plugged by debris in the external fluid, which would thereby increase the pressure of the external fluid acting on the mechanical seals.

The applicant has observed that such features sufficiently pressurize the seal chamber to a positive pressure exceeding the ambient pressure of the external fluid surrounding the pump casing, so as to assist the sealing of the mechanical seals and preventing ingress of water or other contaminants through the mechanical seals, without increasing the size of the pump motor or the pump casing. Without the integrated, internal diffusion volute elements described above, the applicant has found the seal chamber cannot be sufficiently pressurized so as to exceed the ambient pressure of the surrounding external fluids. As an example, without intending to be limiting, the applicant has found that merely introducing an integrated centrifugal oil pump impeller to the interior of the pump casing was only capable of producing a static pressure recovery in the range of approximately 0.5 to 2.0 psi, whereas the required static pressure recovery for a typical submerged pump application is in the range of 10 to 50 psi. The applicant has been able to produce pressurized pump shaft seal assemblies for existing pumps, without increasing the size of the motor or the size of the pump casing, and without introducing additional pressurization mechanisms to the system, such as a compressed gas or a piston, that are capable of producing a static pressure recovery in the range of 10 to 50 psi, by a combination of the design features of the centrifugal oil pump impeller (having enlarged impeller bores and an increased number of impeller bores for an impeller of a given outer diameter), and the inclusion of an integrated, internal diffusion volute element or elements.

The exemplary embodiments herein described are not intended to be exhaustive or to limit the scope of the disclosure to the precise forms disclosed. They are chosen and described to explain the principles of the disclosure and its application and practical use to allow others skilled in the art to comprehend its teachings.

As will be apparent to those skilled in the art in light of the foregoing disclosure, many alterations and modifications are possible in the practice of this disclosure without departing from the scope thereof.

What is claimed is:

1. An integrated pressurized pump shaft seal assembly for a submersible rotary fluid pump, the rotary fluid pump including a rotary fluid pump shaft, a rotary fluid pump motor and a pump casing, the integrated pressurized pump shaft seal assembly comprising:

an oil reservoir having a pressure equal to or less than an ambient pressure of ambient pressure external fluids surrounding the pump casing, the oil reservoir disposed within the pump casing, the oil reservoir having a reservoir outlet flowing into an inlet of a centrifugal oil pump impeller, the oil pump impeller mountable onto, so as to be rotated by, the said rotary fluid pump shaft, the inlet of the centrifugal oil pump impeller comprising a ridge defining an annular void in fluid communication with a plurality of bores extending radially outwardly to a plurality of impeller outlets located at a circumferential edge of the centrifugal oil pump impeller, the plurality of impeller outlets in fluid communication with a diffusion element adjacent the centrifugal oil pump impeller, the diffusion element comprising an internal diffusion bore in fluid communication with an internal volute diffusion element, wherein the internal diffusion bore and internal volute diffusion element converts the velocity of oil pumped from the reservoir by the centrifugal oil pump impeller into static pressure, and wherein the internal volute diffusion element comprises an axially vertical spiral volute diffusion chamber located between an inner wall and an outer wall of a mechanical seal housing, and wherein an outlet of the internal volute diffusion element flows into a seal chamber defined by the mechanical seal housing, and wherein the seal chamber encloses a mechanical shaft seal mountable onto said pump shaft, wherein the mechanical shaft seal prevents ingress of ambient pressure external fluids into the seal chamber, and wherein said centrifugal oil pump impeller pumps said oil received from said oil reservoir to said seal chamber through the diffusion element and the internal volute diffusion element so as to increase a pressure within said seal chamber to a positive pressure above the ambient pressure of the external fluids surrounding the pump housing so as to assist sealing by the mechanical shaft seal of the seal chamber.

2. The integrated pressurized pump shaft seal assembly of claim 1, wherein the mechanical seal housing further comprises one or more of: cooling fins adapted to cool the oil in the said seal chamber; and baffles adapted to reduce at least one of swirl and cavitation in said oil in the vicinity of the said mechanical shaft seal.

3. The integrated pressurized pump shaft seal assembly of claim 1, wherein the mechanical shaft seal comprises first and second mechanical shaft seals.

4. The integrated pressurized pump shaft seal assembly of claim 1, wherein the axially vertical spiral volute diffusion chamber of the internal volute diffusion element has a wrap angle that is at least 90°.

5. The integrated pressurized pump shaft seal assembly of claim 1, wherein the axially vertical spiral volute diffusion chamber has a downward angle selected in the range of 8° to 20°.

6. The integrated pressurized pump shaft seal assembly of claim 1, wherein an inlet angle of the plurality of bores is equal to zero and the outlet angle of the plurality of bores is equal to zero such that a central axis passing through each bore of the plurality of bores is perpendicular to the rotary fluid pump shaft.

7. The integrated pressurized pump shaft seal assembly of claim 1, wherein the diffusion element further comprises a spiral passageway disposed on an upper surface of a bearing housing leading to an inlet of the internal diffusion bore, the internal diffusion bore passing axially and radially through a body of the bearing housing and having an outlet in fluid communication with an inlet of the spiral volute diffusion chamber.

8. The assembly of claim 7, wherein the centrifugal oil pump impeller is positioned above a bearing assembly of the rotary fluid pump.

9. The assembly of claim 1, wherein the internal diffusion bore is linear.

10. The assembly of claim 1, wherein the diffusion element comprises a spiral passageway disposed on a recessed portion of an upper surface of a diffuser leading to an inlet of the internal diffusion bore, the internal diffusion bore passing axially and radially through a body of the diffuser and having an outlet in fluid communication with an inlet of the spiral volute diffusion chamber.

11. The assembly of claim 10, wherein the axially vertical spiral volute diffusion chamber has a wrap angle that is at least 90°.

12. The assembly of claim 10, wherein the centrifugal oil pump impeller is positioned below a bearing assembly of the rotary fluid pump.

13. The assembly of claim 1, wherein the oil pump impeller is sandwiched between the oil reservoir and the diffusion element.

14. A rotary fluid pump comprising a rotary fluid pump motor, a rotary fluid pump shaft connected to said pump motor, a pump impeller mounted to said pump shaft and an integrated pressurized pump shaft seal assembly mounted to said pump shaft, the integrated pressurized pump shaft seal assembly comprising:

an oil reservoir having a pressure equal to or less than an ambient pressure of ambient pressure external fluids surrounding a pump casing, the oil reservoir disposed within the pump casing, the oil reservoir having a reservoir outlet flowing into an inlet of a centrifugal oil pump impeller, the oil pump impeller mountable onto, so as to be rotated by, the said rotary fluid pump shaft, the inlet of the centrifugal oil pump impeller comprising a ridge defining an annular void in fluid communication with a plurality of bores extending radially outwardly to a plurality of impeller outlets located at a circumferential edge of the centrifugal oil pump impeller, the plurality of impeller outlets in fluid communication with an internal volute diffusion element adjacent the centrifugal oil pump impeller, wherein the internal volute diffusion element converts the velocity of oil pumped from the reservoir by the centrifugal oil pump impeller into static pressure, and wherein the internal volute diffusion element comprises an axially vertical spiral volute diffusion chamber located between an inner wall and an outer wall of a mechanical seal housing, and wherein an outlet of the internal volute diffusion element flows into a seal chamber defined by the mechanical seal housing, and wherein the seal chamber encloses a mechanical shaft seal mountable onto said pump shaft, wherein the mechanical shaft seal prevents ingress of ambient pressure external fluids into the seal chamber, and wherein said centrifugal oil pump impeller pumps said oil received from said oil reservoir to said seal chamber through the internal volute diffusion element so as to increase a pressure within said seal chamber to a positive pressure above the ambient pressure of the external fluids surrounding the pump housing so as to assist sealing by the mechanical shaft seal of the seal chamber.

15. The rotary fluid pump of claim 14, further comprising a diffusion element having an internal diffusion bore, the internal diffusion bore in fluid communication with the outlet of the centrifugal oil pump impeller and an inlet of the volute diffusion chamber, wherein the pumped oil is transported from the outlet of the centrifugal oil pump impeller to the inlet of the volute diffusion chamber.

16. The rotary fluid pump of claim 14, additionally comprising a check valve located between the integrated centrifugal oil pump impeller and the seal chamber.

17. The rotary fluid pump of claim 14 further comprising a wet end having an open stool, the open stool comprising the wet end vent so as to reduce the pressure of the external fluids acting on the mechanical seal generated by a pump impeller of the said wet end.

18. The rotary fluid pump of claim 14, additionally comprising a cooling jacket adapted for cooling said pump motor, wherein said cooling jacket is fluidly connected to said seal chamber by a pressure reducing valve and adapted to receive pressurized oil from said seal chamber while maintaining the positive pressure in the seal chamber and to return warmed oil from said cooling jacket to said oil reservoir.

* * * * *